US008461939B2

(12) United States Patent
Lan et al.

(10) Patent No.: US 8,461,939 B2
(45) Date of Patent: Jun. 11, 2013

(54) WAVEGUIDE ORTHOMODE TRANSDUCER

(75) Inventors: I-Ching Lan, Taipei Hsien (TW); Chung-Min Lai, Taipei Hsien (TW); Chang-Hsiu Huang, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 438 days.

(21) Appl. No.: 12/793,681

(22) Filed: Jun. 4, 2010

(65) Prior Publication Data

US 2011/0109409 A1 May 12, 2011

(30) Foreign Application Priority Data

Nov. 12, 2009 (TW) ..... 98138443 A

(51) Int. Cl.
*H01P 5/12* (2006.01)

(52) U.S. Cl.
USPC ..... 333/135; 333/126; 333/137

(58) Field of Classification Search
USPC ..... 333/135, 126, 137
See application file for complete search history.

(56) References Cited

U.S. PATENT DOCUMENTS

| | | | | |
|---|---|---|---|---|
| 3,978,434 | A * | 8/1976 | Morz et al. | 333/135 |
| 5,245,353 | A * | 9/1993 | Gould | 343/786 |
| 5,392,008 | A * | 2/1995 | Wong | 333/21 R |
| 5,959,508 | A * | 9/1999 | Aitken | 333/126 |
| 7,432,780 | B2 * | 10/2008 | Chan et al. | 333/127 |

* cited by examiner

*Primary Examiner* — Robert Pascal
*Assistant Examiner* — Kimberly Glenn
(74) *Attorney, Agent, or Firm* — Winston Hsu; Scott Margo

(57) ABSTRACT

A waveguide orthomode transducer includes a waveguide including a first waveguide portion and a second waveguide portion placed along a transmission direction of radio signals, the size of an aperture of the second waveguide portion smaller than the size of an aperture of the first waveguide portion, a first probe disposed at a first position, a second probe disposed at a second position, a third probe disposed at a third position, and a fourth probe disposed at a fourth position, wherein at least two of the first position, the second position, the third position, and the fourth position are located in the same plane perpendicular to the transmission direction of the radio signals.

28 Claims, 23 Drawing Sheets

WAVEGUIDE ORTHOMODE TRANSDUCER

BACKGROUND OF THE INVENTION

1. Field of the Invention

The present invention relates to a waveguide orthomode transducer, and more particularly, to a dual-band waveguide orthomode transducer.

2. Description of the Prior Art

Satellite communication is distinguished in wide coverage and terrestrial interference avoidance, and is widely used in military, probe, and commercial communication services, such as satellite navigation, satellite voice broadcasting, and satellite television broadcasting. A prior art satellite communication receiver consists of a dish reflector and a low noise block down-converter with feedhorn (LNBF); the LNBF is disposed on the focus of the dish reflector, receiving radio signals reflected via the dish reflector, down-converting the radio signals to middle band, and then transmitting the radio signals to a backend satellite signal processor for signal processing, enabling the playing of satellite television programs.

A single-band LNBF consists of a feedhorn, an orthomode transducer (OMT) and a low noise block down-converter (LNB), wherein the orthomode transducer is one of the key components, for separating two orthogonal polarized radio signals to be outputted from different output ports. Please refer to FIG. 1, FIG. 1 is a half longitudinal sectional view of an orthomode transducer 10 according to the prior art. The orthomode transducer 10 is a waveguide orthomode transducer composed by a rectangular waveguide 11, probes $P_1$ and $P_2$, and a short-circuit pin 12. The waveguide 11 is composed by four surrounding conducting walls, which is open for connecting an antenna at one end and closed at the other end. The probes $P_1$ and $P_2$ are formed by inner conductors of coaxial cables, passing through the conducting walls of the waveguide 11 and entering the waveguide 11. The probe $P_1$ is parallel to the X axis, and is the output port that outputs X-polarized signals, and the probe $P_2$ is parallel to the Y axis, and is the output port that outputs Y-polarized signals. The short-circuit pin 12 is parallel to the X axis, located at the position near the center of the waveguide 11, connecting two parallel conducting walls. The short-circuit pin 12 provides a function of polarization enabling most of the X-polarized signals be reflected and outputted from the probe $P_1$ with little influence on the Y-polarized signals, and most of the Y-polarized signals can be successfully outputted from the probe $P_2$.

With the growth of the needs to satellite television, the number of frequency bands covered by the direct broadcast satellite is increasing, and the prior art single-band LNBF is not sufficient anymore. The LNBF must be at least capable of receiving dual-band signals, i.e. the low frequency Ku band (12-18 GHz) and the high frequency Ka band (26.5-40 GHz) signals. Please refer to FIG. 2. FIG. 2 is a schematic diagram of a dual-band LNBF 20 according to the prior art. The LNBF 20 consists of a feedhorn 200, a low frequency orthomode transducer 202, a high frequency orthomode transducer 204 and an LNB circuit 206. The feedhorn 200 receives low frequency and high frequency radio signals. The orthomode transducer 202 separates two orthogonal polarized low frequency radio signals S1 and S2, and the orthomode transducer 204 separates two orthogonal polarized high frequency radio signal S3 and S4, making the radio signals S1-S4 be outputted from corresponding output ports to the LNB circuit 206. From the above, besides fairly separating the orthogonal polarized low frequency radio signals S1 and S2, the orthomode transducer 202 must also ensure that the high frequency radio signals S3 and S4 passing through the orthomode transducer 202 without interference as far as possible.

Nevertheless, if the dual-band LNBF 20 utilizes the orthomode transducer 10 in FIG. 1 as the low frequency orthomode transducer 202, the short-circuit pin 12 in the orthomode transducer 10 would also reflect part of high frequency X-polarized signals and output them from the probe $P_1$, such that the high frequency X-polarized signals is unable to pass through the orthomode transducer 202 and cannot be transmitted to the orthomode transducer 204 successfully. Furthermore, since the probes $P_1$ and $P_2$ stretch excessively deep into the internal part of the waveguide 11, the high frequency polarized signals would also be reflected and be outputted from the probes $P_1$ and $P_2$; hence, not only the decay of the high frequency signals are increased, isolation between the high frequency signals and the low frequency signals is decreased. Moreover, while passing through the orthomode transducer 10, the high frequency polarized signals will be excited to higher-order modes at discontinuous probes $P_1$ and $P_2$. If these higher-order mode excitation signals are transmitted to the antenna, the high-frequency radiation patterns will be severely distorted. Considering the above flaws, the orthomode transducer 10 is not feasible for the dual-band LNBF 20, which possibly results in a downgrade effectiveness of the LNBF 20 when receiving the high frequency satellite signals, and hence affects the playing quality of a satellite television.

SUMMARY OF THE INVENTION

It is therefore a primary objective of the claimed invention to provide a waveguide orthomode transducer.

The present invention discloses a waveguide orthomode transducer including a waveguide comprising a first waveguide portion and a second waveguide portion placed along a transmission direction of radio signals, the size of an aperture of the second waveguide portion smaller than the size of an aperture of the first waveguide portion, a first probe disposed at a first position, a second probe disposed at a second position, a third probe disposed at a third position, and a fourth probe disposed at a fourth position, wherein at least two of the first position, the second position, the third position, and the fourth position are located in the same plane perpendicular to the transmission direction of the radio signals.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
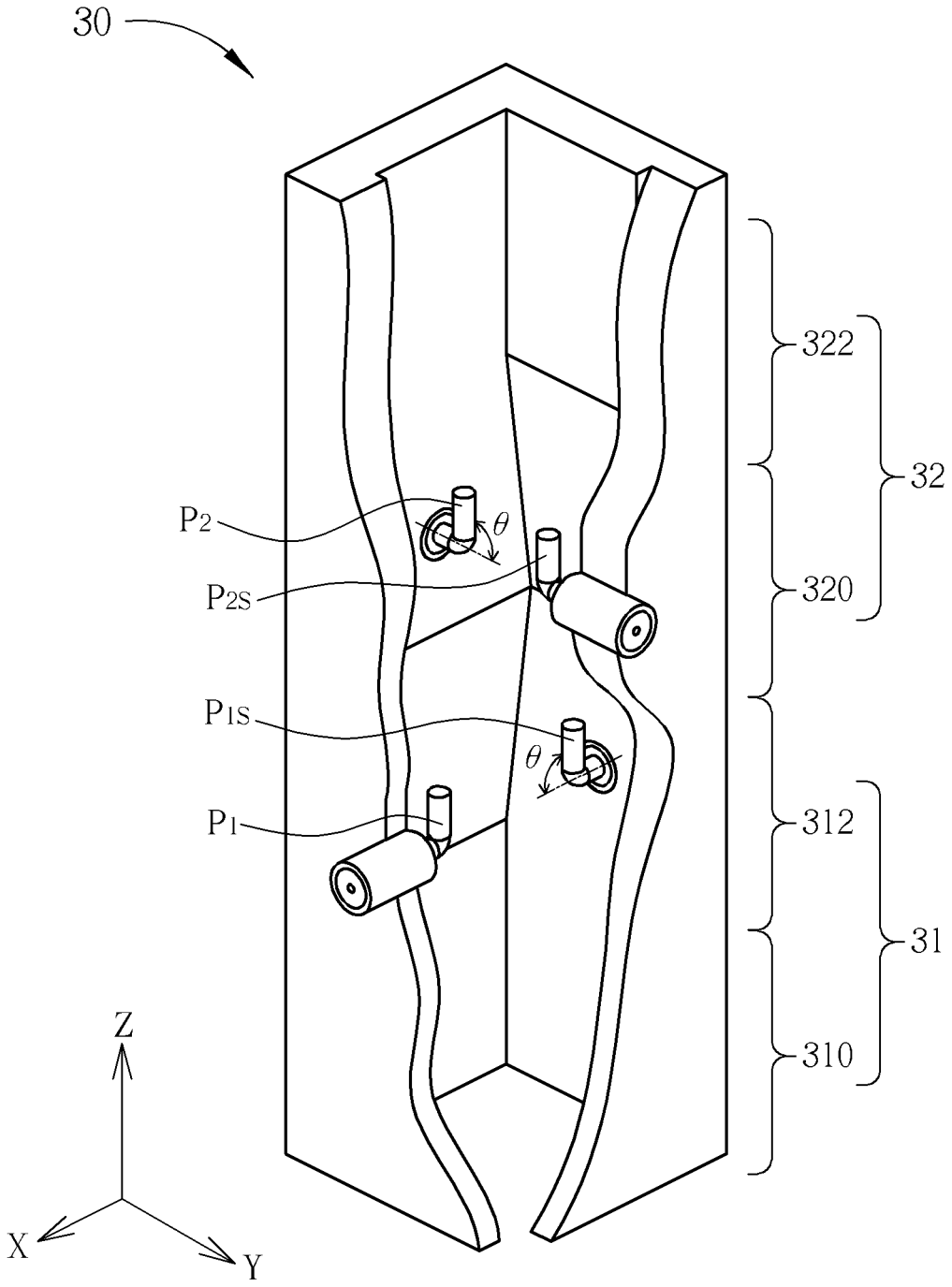
FIG. 3 is a half longitudinal sectional view of an orthomode transducer according to an embodiment of the present invention.

Please refer to FIG. 3. FIG. 3 is a half longitudinal sectional view of an orthomode transducer 30 according to an embodiment of the present invention. The orthomode transducer 30 is a waveguide orthomode transducer, feasible for a dual-band LNBF as an orthomode transducer for low frequency band, which is connected with an antenna at one end and an orthomode transducer for high frequency band at the other end. The orthomode transducer 30 comprises waveguide portions 31 and 32, and probes $P_1$, $P_{1S}$, $P_2$, and $P_{2S}$. In practice, the orthomode transducer 30 is a complete waveguide with various thickness of conducting walls; for clarity, in FIG. 3 the waveguide is segmented into the waveguide portion 31 and the waveguide portion 32. The waveguide portion 31 and the waveguide portion 32 are formed by conducting walls with different thickness respectively. The probes $P_1$ and $P_2$ are utilized as the output ports to output low frequency radio signals transmitted in the orthomode transducer 30, including low frequency X-polarized signals and Y-polarized signals, and the probe $P_{1S}$ and probe $P_{2S}$ are short-circuited (not illustrated in figures). Please note herein, the following longitudinal section of the orthomode transducer 30 is parallel to the Z axis, and the cross section of the orthomode transducer 30 is parallel to the XY plane.

Figure 1:
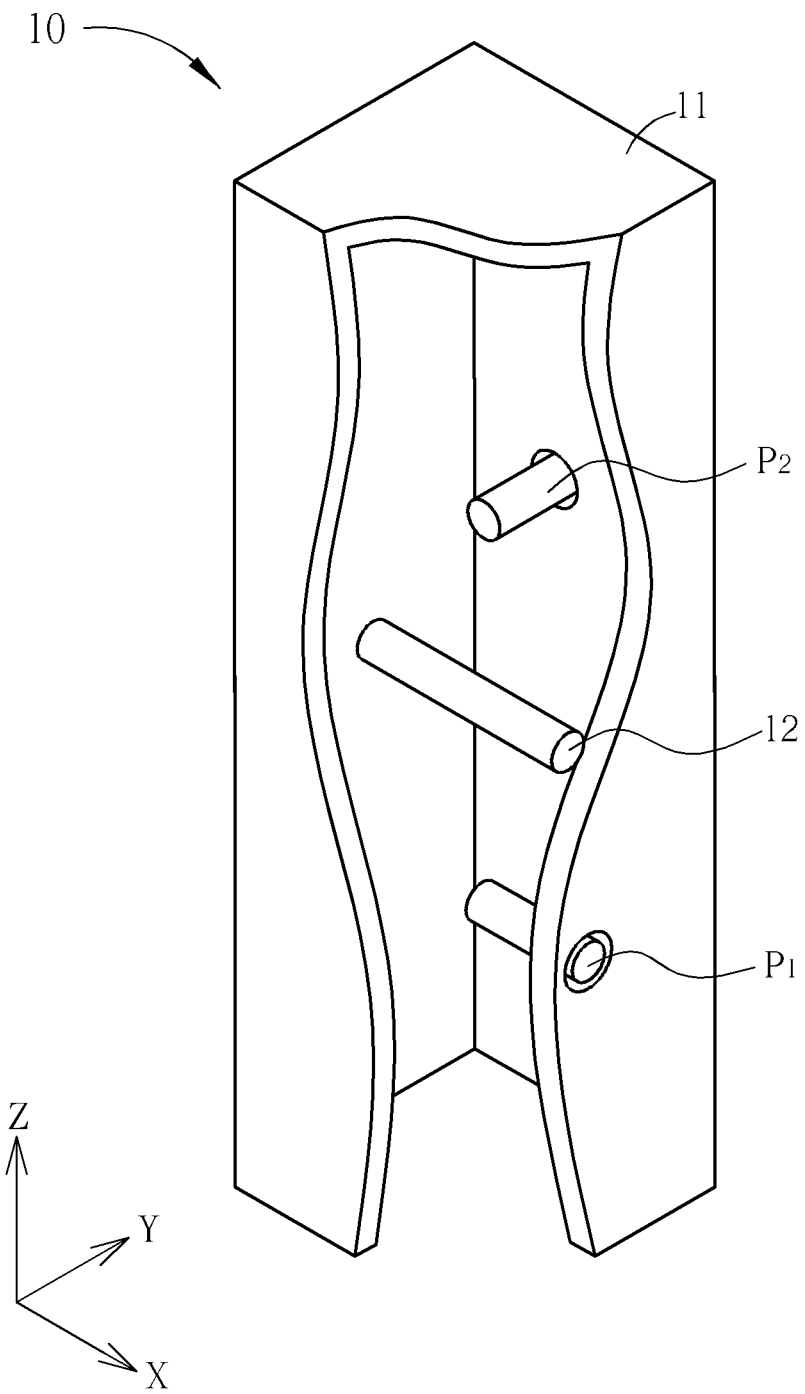
FIG. 1 PRIOR ART
FIG. 1 is a half longitudinal sectional view of an orthomode transducer according to the prior art.
Figure 2:
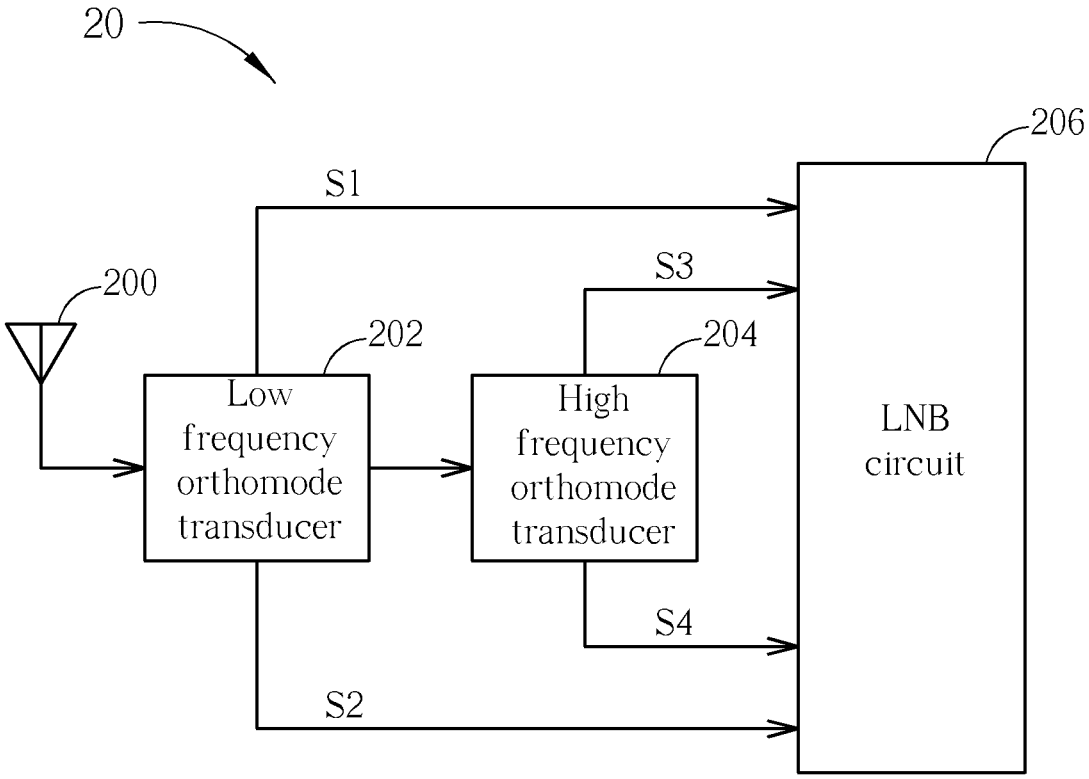
FIG. 2 PRIOR ART
FIG. 2 is a schematic diagram of a dual-band LNBF according to the prior art.

It can be seen from FIG. 3 that the orthomode transducer 30 is obviously different from the orthomode transducer 10 in FIG. 1 since the size of the aperture that forms the orthomode transducer 30 is not uniform. Part of the inner surface of conducting walls is parallel to the longitudinal axis of the waveguide, i.e. the Z axis in FIG. 3, while the other part of the inner surface of the conducting walls slopes to Z axis, making the internal space of the waveguide of the orthomode transducer 30 tapers toward the +Z direction, which is also the transmission direction of radio signals. On the other hand, despite that the internal space of the waveguide of the orthomode transducer 30 is tapered, the conducting walls can be fabricated to make the orthomode transducer 30 a rectangular column with equal size of cross sections, as illustrated in FIG. 3, or a circular column. The aperture and external appearance of the waveguide of the orthomode transducer 30 can be designed independently, and the external appearance has no influence on the essence of the present invention. Therefore, in the following description and part of the figures, the thickness of the conducting walls will be omitted; only the internal space will be described, for the sake of conciseness.

Figure 4A:
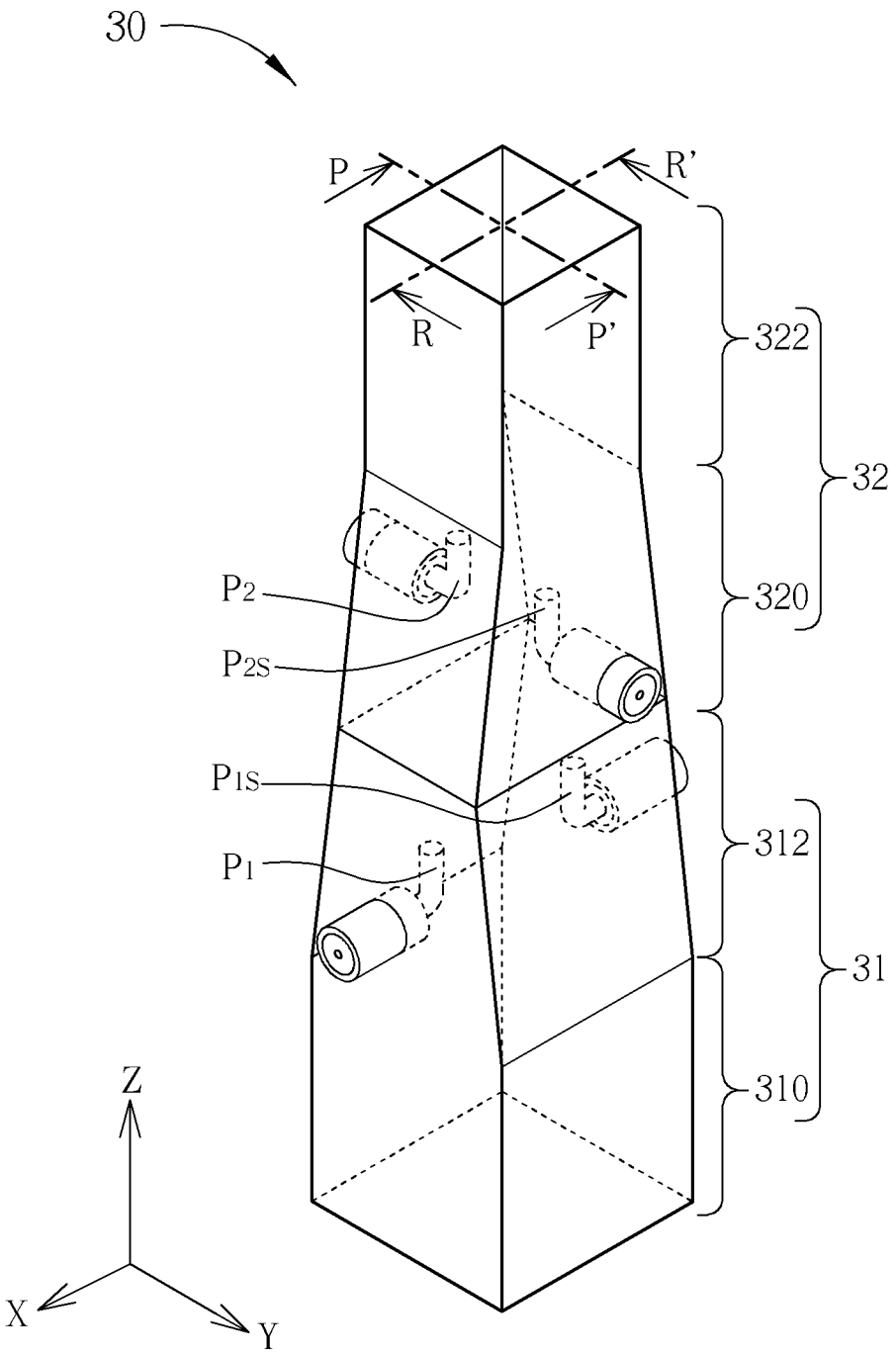
FIG. 4A is an isometric view of the orthomode transducer in FIG. 3.
Figure 4B:
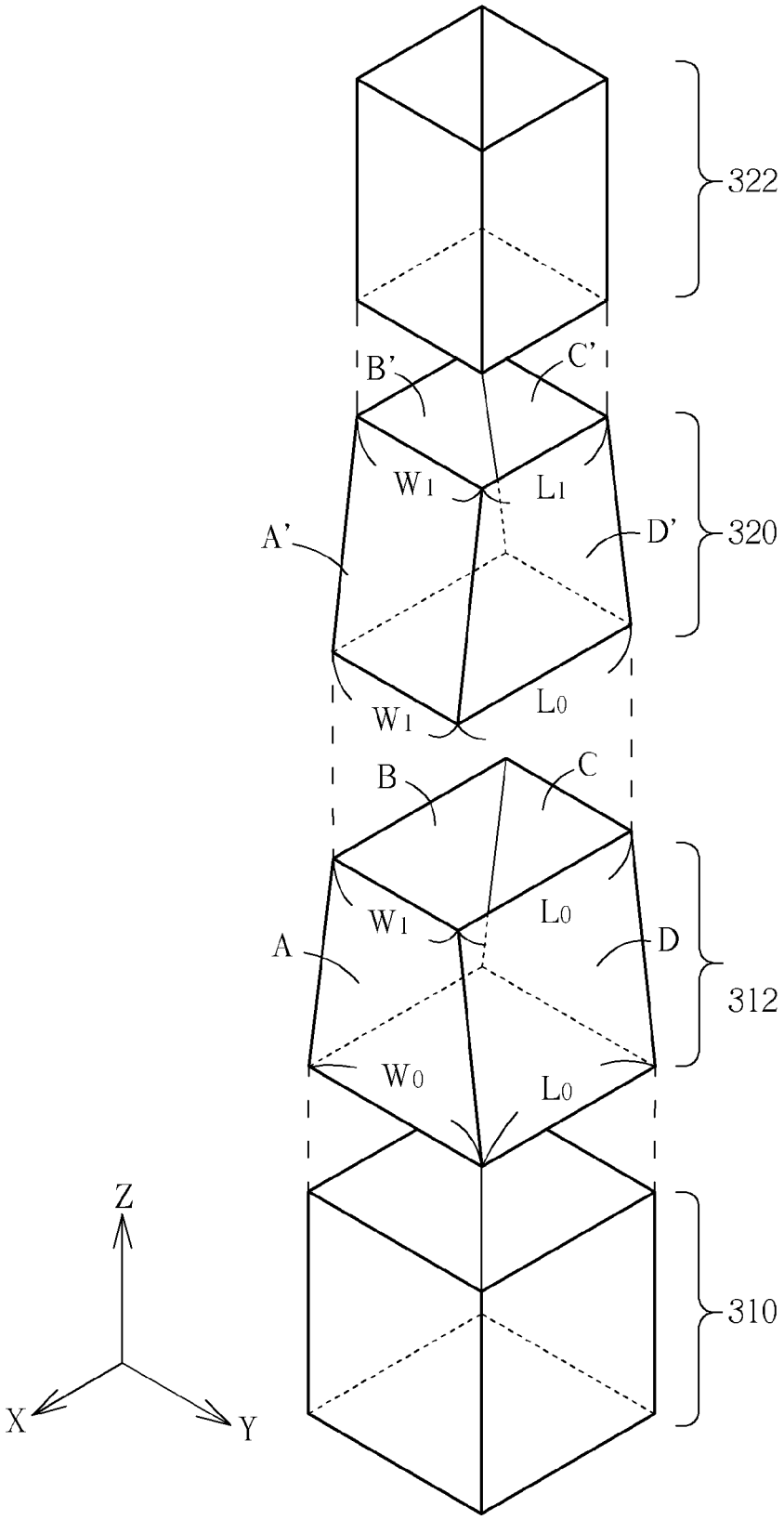
FIG. 4B is an exploded view of the waveguide portions of the orthomode transducer in FIG. 3.
Figure 5A:
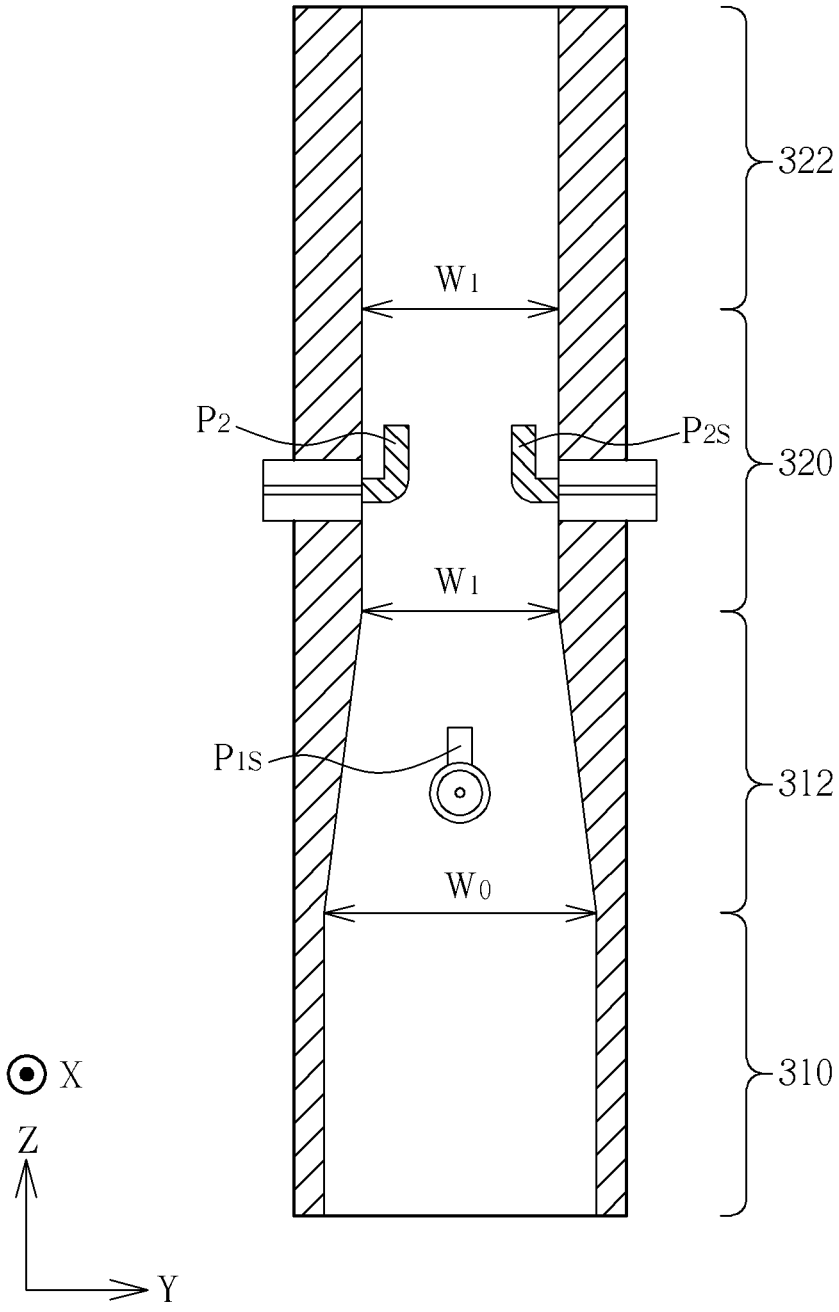
FIG. 5A and FIG. 5B are longitudinal sectional views of the orthomode transducer in FIG. 3.
Figure 5B:
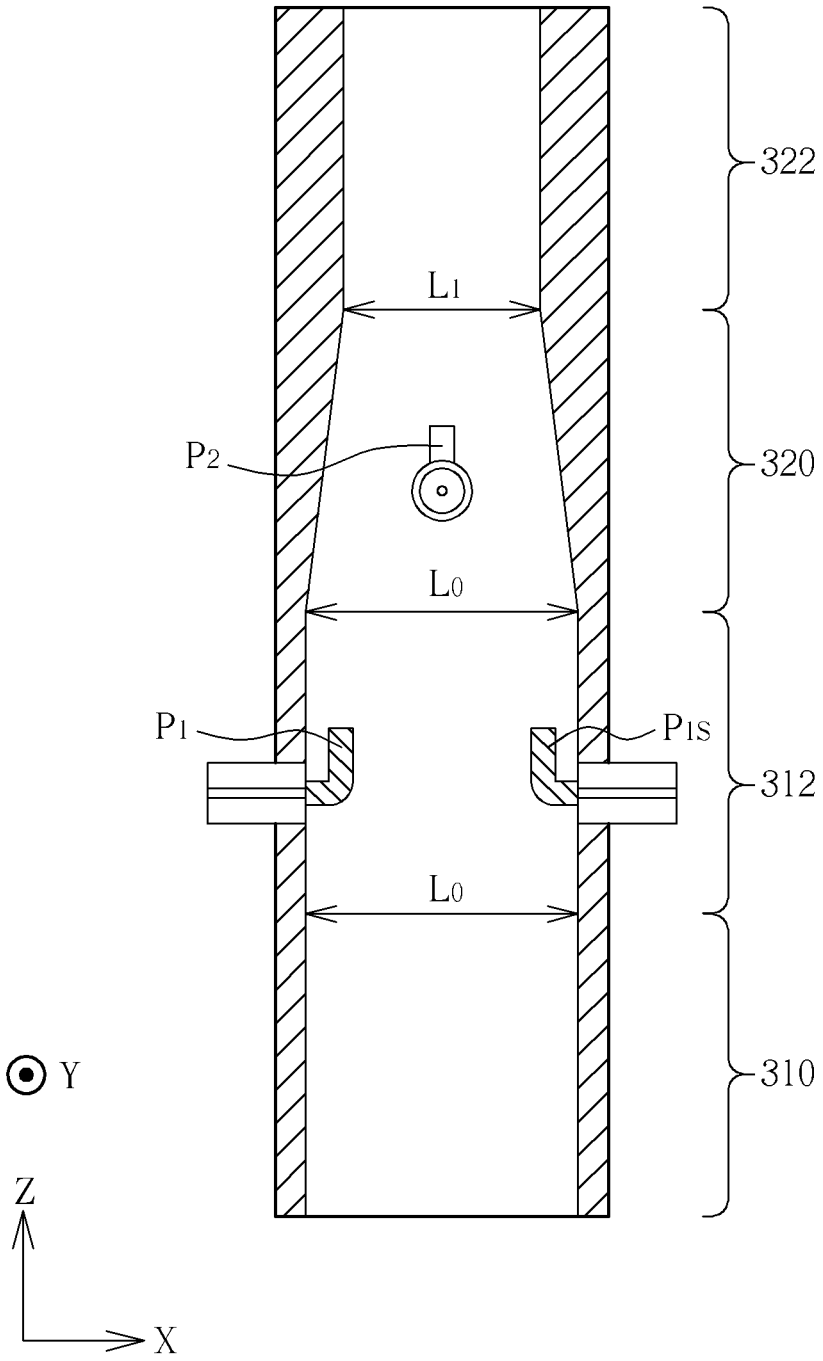

Please refer to FIGS. 4A and 4B. FIG. 4A is an isometric view of the orthomode transducer 30, and FIG. 4B is an exploded view of the waveguide portion 31 and the wave guide portion 32 of the orthomode transducer 30. In these two figures, only the internal space formed by the conducting walls is depicted, while the thickness of the conducting wall is omitted. In addition, please also refer to FIG. 5A and FIG. 5B, which are longitudinal sectional views of the orthomode transducer 30 in FIG. 3 along the P-P' section line and the R-R' section line in FIG. 4A respectively, wherein the thickness of the conducting walls is depicted. The relative position of each waveguide portions and probes can be seen in FIG. 4A and FIG. 4B, and the position at which the internal space of the waveguide tapers can be realized in FIG. 5A and FIG. 5B.

Considering FIG. 3 to FIG. 5B, in details, the waveguide portion 31 is formed by a waveguide portion 310 and a waveguide portion 312, and the waveguide portion 32 is formed by a waveguide portion 320 and a waveguide portion 322. The waveguide portion 31 and the waveguide portion 32 form a complete waveguide. The waveguide portion 310 is formed by four surrounding conducting walls, and comprises an open end for connecting an antenna of an LNBF and the other open end combined with the waveguide portion 312. Each conducting walls of the waveguide portion 310 is parallel to the Z axis, hence, the size of the aperture of the waveguide portion 310 is equal. As shown in FIG. 4B, the waveguide portion 312 is formed by surrounding conducting walls A, B, C, and D, and comprises an open end combined with the waveguide portion 310 and the other open end combined with the waveguide portion 320. The conducting walls A and C of the waveguide portion 312 are parallel to YZ plane and are trapezoids, hence, the conducting walls B and D are rectangles and slope toward the +Z direction, making the size of the aperture of the waveguide portion 312 in the Y direction smoothly taper. It can be seen from FIG. 4B that the size of the aperture of the waveguide portion 312 in the Y direction tapers from $W_0$ to $W_1$, hence the internal space of the waveguide portion 312 tapers toward the +Z direction, and the size of the aperture of the waveguide portion 312 tapers from $W_0 \times L_0$ to $W_1 \times L_0$.

The waveguide portion 32 is formed by a waveguide portion 320 and a waveguide portion 322. As shown in FIG. 4B, the waveguide portion 320 is formed by surrounding conducting walls A', B', C', and D', and comprises an open end combined with the waveguide portion 312 and the other open end combined with the waveguide portion 322. The conducting walls B' and D' of the waveguide portion 320 are parallel to XZ plane and are trapezoids, hence, the conducting walls A' and C' are rectangles and slope towards the +Z direction, making the size of the aperture of the waveguide portion 320 in the X direction smoothly taper. It can be seen from FIG. 4B that the size of the aperture of the waveguide portion 320 in the X direction tapers from $L_0$ to $L_1$, hence the internal space of the waveguide portion 320 tapers toward the +Z direction, and the size of the aperture of the waveguide portion 320 tapers from $W_1 \times L_0$ to $W_1 \times L_1$. The waveguide portion 322 is formed by four surrounding conducting walls, and comprises an open end combined with the waveguide portion 320 and the other open end capable to be combined with an orthomode transducer for high frequency band. Each conducting walls of the waveguide portion 322 is parallel to the Z axis, and the size of the aperture of the waveguide portion 322 is equal.

It can be seen from the above, since the orthomode transducer 30 has two tapered waveguide portions, the size of the aperture smoothly tapers toward different directions. Because the first tapered waveguide portion 312 tapers first toward the Y direction, the low frequency X-polarized signals gradually enter a cut-off status and become unable to be transmitted while proceeding in the waveguide portion 312, and most energy is reflected into corresponding low frequency signal output port, i.e. the probe $P_1$. In other words, the waveguide portion 312 has the effect similar to the short-circuit pin 12 of the orthomode transducer 10 in FIG. 1. As to the high frequency X-polarized signals, as long as the size of the aperture of the waveguide portion 312 after tapered (which is $W_1 \times L_0$ as illustrated in FIG. 4B) does not force them enter the cut-off status, the high frequency X-polarized signals are able to pass through the waveguide portion 312 successfully and reach the high frequency band orthomode transducer. On the other hand, the waveguide portion 312 has only little impact on the high frequency and low frequency Y-polarized signals. In brief, the tapered waveguide portion 312 provides the effect similar to the short-circuit pin; nevertheless, it excludes the flaw of the short-circuit pin that the high frequency X-polarized signals cannot pass through successfully.

Similarly, since the second tapered waveguide portion 320 tapers toward the X direction, the low frequency Y-polarized signals gradually enter the cut-off status and become unable to be transmitted while proceeding in the waveguide portion 320, and most energy is reflected into corresponding low frequency signal output port, i.e. the probe $P_2$. As to the high frequency Y-polarized signals, as long as the size of the aperture of the waveguide portion 320 after tapered does not force them enter the cut-off status, the high frequency Y-polarized signals are able to pass though the waveguide portion 320 successfully. On the other hand, the waveguide portion 320 has only little impact on the high frequency and low frequency X-polarized signals. With these two-staged taper of the size of the aperture of the waveguide, the orthomode transducer 30 is capable of fairly separating the high frequency and low frequency radio signals, and keeping the operations of two low frequency polarized signals characterized in wide-band.

The probes $P_1$, $P_{1S}$, $P_2$, and $P_{2S}$ of the orthomode transducer 30 are described as follows. The probes $P_1$, $P_{1S}$, $P_2$, and $P_{2S}$ are conductors, in FIG. 3, inner conductors of coaxial cable are took as an example. The probe $P_1$ and the probe $P_{1S}$ are symmetric to each other about the Z axis, tunneling the conducting wall A and the conducting wall C respectively from the external of the tapered waveguide portion 312 into the internal of the waveguide portion 312, and forming a bend in the internal of the waveguide portion 312 toward the +Z direction. The angle of the bend is θ in FIG. 3, which is approximately 90 degree. The line passing through the positions where the probe $P_1$ and the probe $P_{1S}$ tunnel the conducting walls is approximately perpendicular to the Z axis. The probe $P_2$ and the probe $P_{2S}$ are symmetric to each other about the Z axis, tunneling the conducting wall B' and the conducting wall D' respectively from the external of the tapered waveguide portion 320 into the internal of the waveguide portion 320, and forming a bend in the internal of the waveguide portion 320 toward the +Z direction. The angle of the bend is θ, which is approximately 90 degree. The line passing through the positions where the probe $P_2$ and the probe $P_{2S}$ tunnel the conducting walls is approximately perpendicular to the Z axis, and the projection of the line on a cross section of the orthomode transducer 30 (i.e. the projection on the XY plane) is approximately perpendicular to a projection of the line passing through the positions where the probe $P_1$ and the probe $P_{1S}$ tunnel the conducting walls on the cross section of the orthomode transducer 30.

The probe $P_{1S}$ and the probe $P_{2S}$ are short-circuited outside the internal space of the waveguide, and are connected to the conducting walls of the waveguide. In FIG. 3, the probe $P_1$ and the probe $P_2$ are combined with a coaxial cable connector, and hence the orthomode transducer 30 is able to be connected with the back-end circuits via the coaxial cable.

Figure 6:
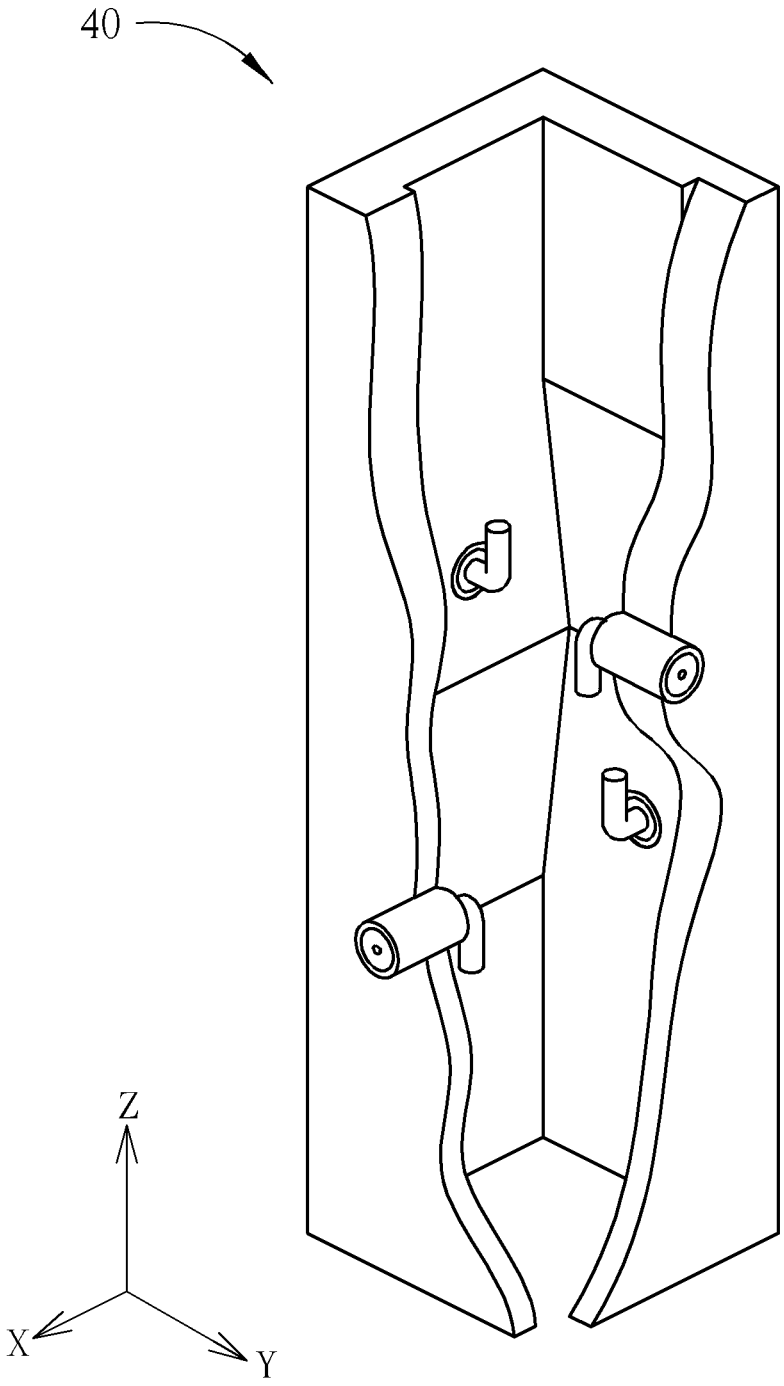
FIG. 6 is a half longitudinal sectional view of an orthomode transducer according to an embodiment of the present invention.

The primary objective of each of the above probes forming the bend in the internal of the waveguide is to shorten the length that the probe stretches into the waveguide, to avoid the interference with the transmission of the high frequency signals in the waveguide, and further enhance the quality of the high frequency signals. The present invention poses no limits on the angles of the bends, which can be larger or smaller than 90 degree, nevertheless, while the angles of the bends do not exceed 90 degree, the probes are equal to approaching the center of the waveguide, and may probably have more interference with the transmission of the high frequency signals. The probes $P_1$, $P_{1S}$, $P_2$, and $P_{2S}$ of the orthomode transducer 30 bend toward the +Z direction, and the bending direction is merely an embodiment of the present invention; in other embodiments of the orthomode transducers, the probes can also bend toward the −Z direction, and the bending direction of two probes in the same waveguide portion can either be identical or opposite. Please refer to FIG. 6. FIG. 6 is a half longitudinal sectional view of an orthomode transducer 40 according to an embodiment of the present invention. The orthomode transducer 40 is similar to the orthomode transducer 30 in FIG. 3, the only difference is that in the orthomode transducer 40, parts of the probes bend toward +Z direction, while others bend toward −Z direction.

Please note that the symmetric probe $P_1$ and probe $P_{1S}$ and the symmetric probe $P_2$ and probe $P_{2S}$ of the orthomode transducer 30 are able to make the higher-order mode excitation generated at the probe $P_1$ and the higher-order mode excitation generated at the probe $P_{1S}$ while the high frequency radio signals passing through the orthomode transducer 30 having the same amount of energy and the opposite phase, and therefore be suppressed and cannot be transmitted in the waveguide of the orthomode transducer 30. Similarly, the higher-order mode excitation generated at the probe $P_2$ and the higher-order mode excitation generated at the probe $P_{2S}$ are suppressed and cannot be transmitted in the waveguide of the orthomode transducer 30. Therefore, when the high frequency radio signals are passing through the orthomode transducer 30, the higher-order mode excitation generated by the probes would not be transmitted to the antenna, ensuring the high-frequency radiation patterns from distortions. Please note that the probe $P_{1S}$ and probe $P_{2S}$ are short-circuited in the orthomode transducer 30 based on the consideration of the requirements of the system design or the cost reduction of the elements to reduce the number of the output ports. In other applications, the probe $P_{1S}$ and the probe $P_{2S}$ can also be connected to the connector of the coaxial cable, making the coaxial cable connected thereupon, hence, the probe $P_{1S}$ and the probe $P_{2S}$ can also output low frequency X-polarized signals and Y-polarized signals, meanwhile, the higher-order mode excitation generated by each probes can be effectively suppressed.

It can be seen from the above that the essence of the present invention is in the multiple waveguide portions of the low frequency band orthomode transducer, the low frequency horizontal and vertical polarized signals enter the cut-off status respectively while transmitting in the waveguide portions owing to the taper of the size of the aperture of waveguide portions toward different direction, and can be reflected to the corresponding output ports. In brief, with the taper of the size of the aperture of waveguide portions, the orthomode transducer of the present invention reflects the low frequency horizontal and vertical polarized signals to the corresponding output ports.

Figure 7A:
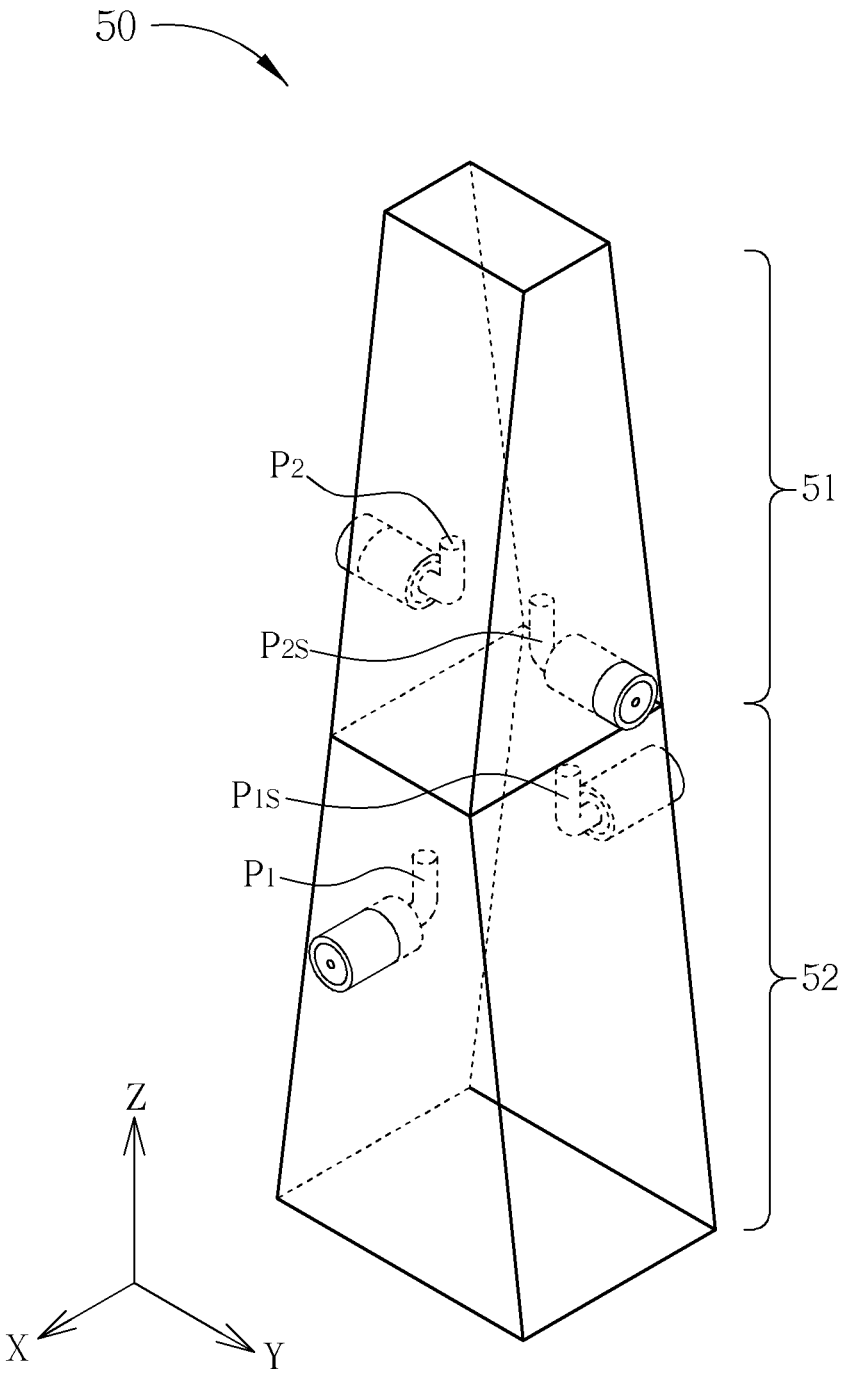
FIG. 7A is an isometric view of an orthomode transducer according to an embodiment of the present invention.
Figure 7B:
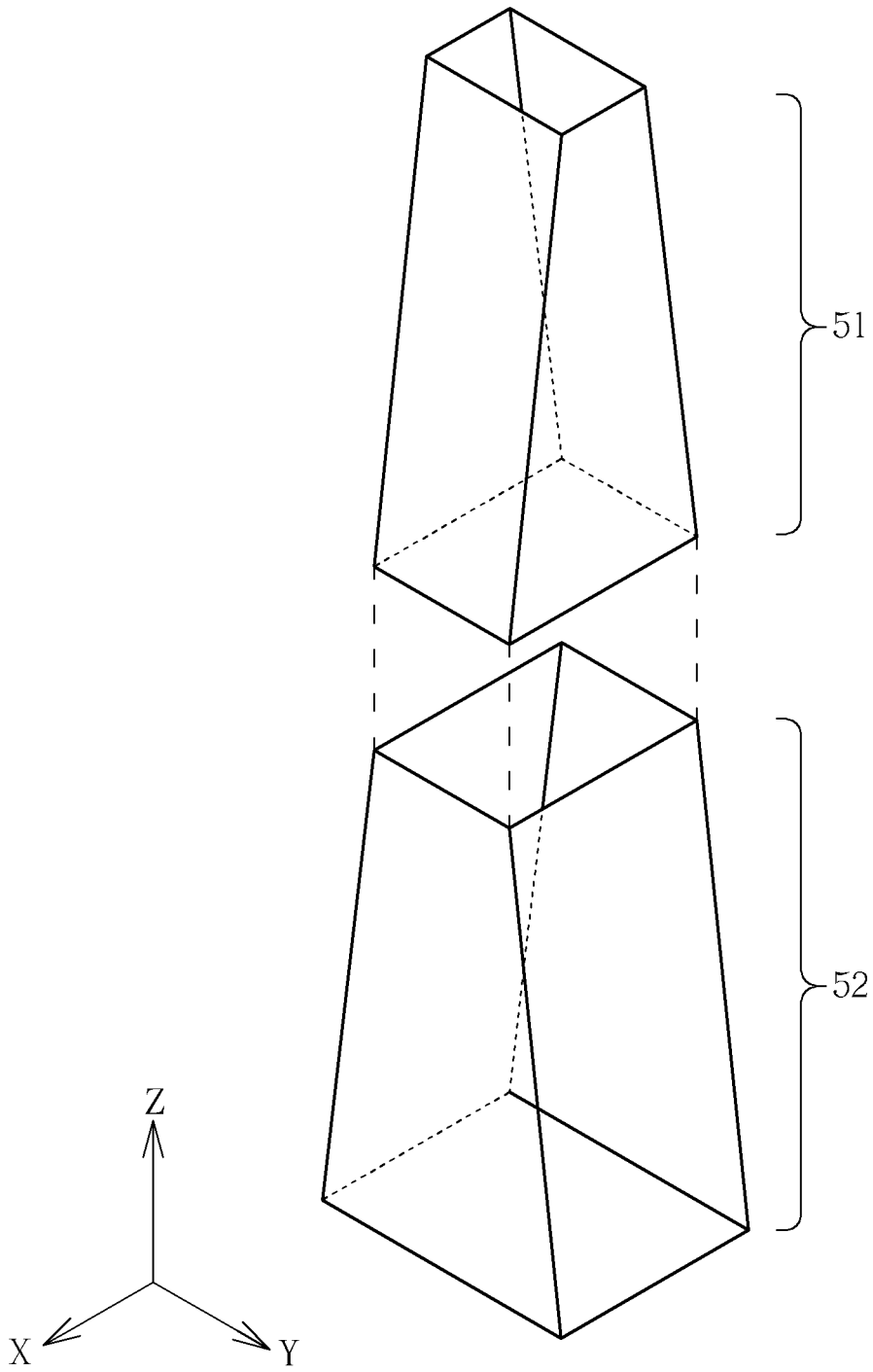
FIG. 7B is an exploded view of the waveguide portions of the orthomode transducer in FIG. 7A.

In the above figures, the shape of each waveguide portions of the orthomode transducer 30 is merely an embodiment of the present invention, and those skilled in the art can make alterations and modifications accordingly, such as adjusting the length of the tapered waveguide portions. Please refer to FIG. 7A and FIG. 7B. FIG. 7A is an isometric view of an orthomode transducer 50 according to an embodiment of the present invention. The orthomode transducer 50 comprises waveguide portions 51 and 52, and probes $P_1$, $P_{1S}$, $P_2$, and $P_{2S}$. FIG. 7B is an exploded view of the waveguide portion 51 and waveguide portion 52 of the orthomode transducer 50. It can be seen from FIG. 7A and FIG. 7B that the orthomode transducer 50 comprises only two waveguide portions, and the sizes of the apertures smoothly taper toward different directions, which are similar to the waveguide portions 312 and 320 of the orthomode transducer 30. The orthomode transducer 50 can be regarded as a variation of the orthomode transducer 30, which shortens the length of the waveguide portions 310 and 322 to a minimum value.

Figure 8A:
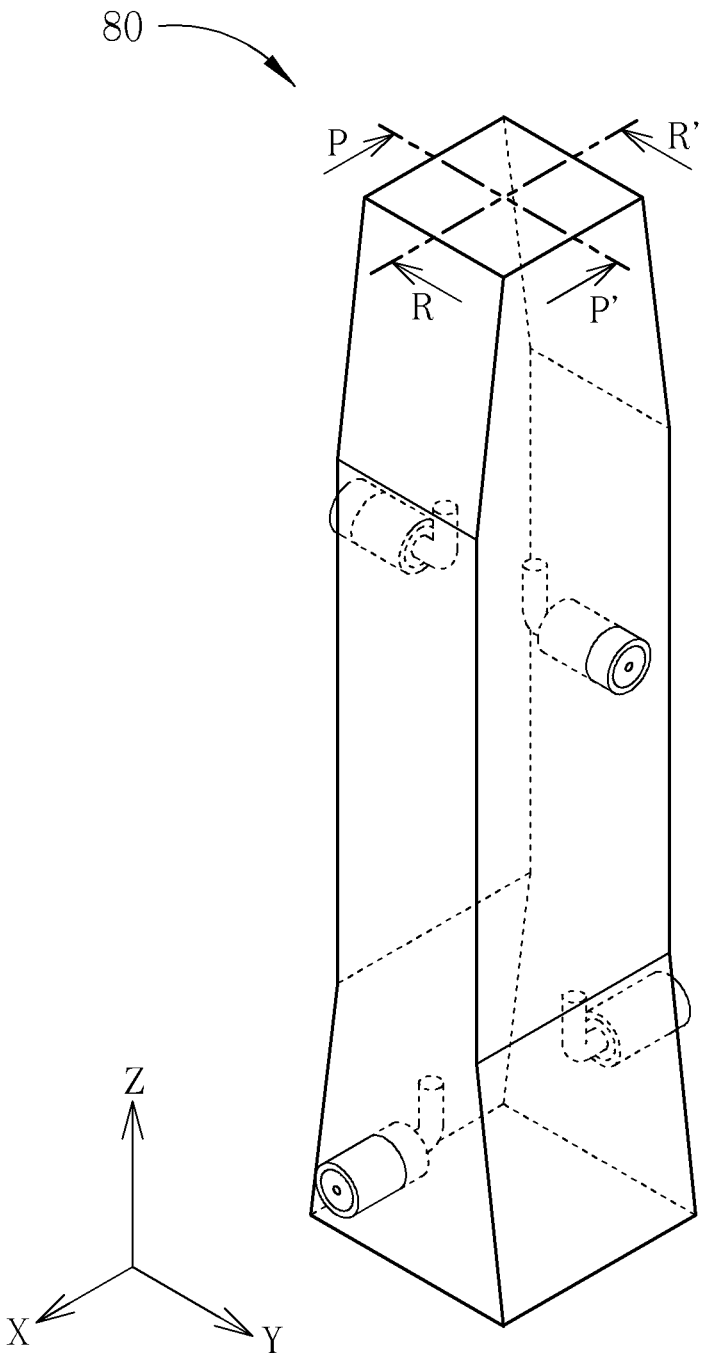
FIG. 8A is an isometric view of an orthomode transducer according to the present invention.
Figure 8B:
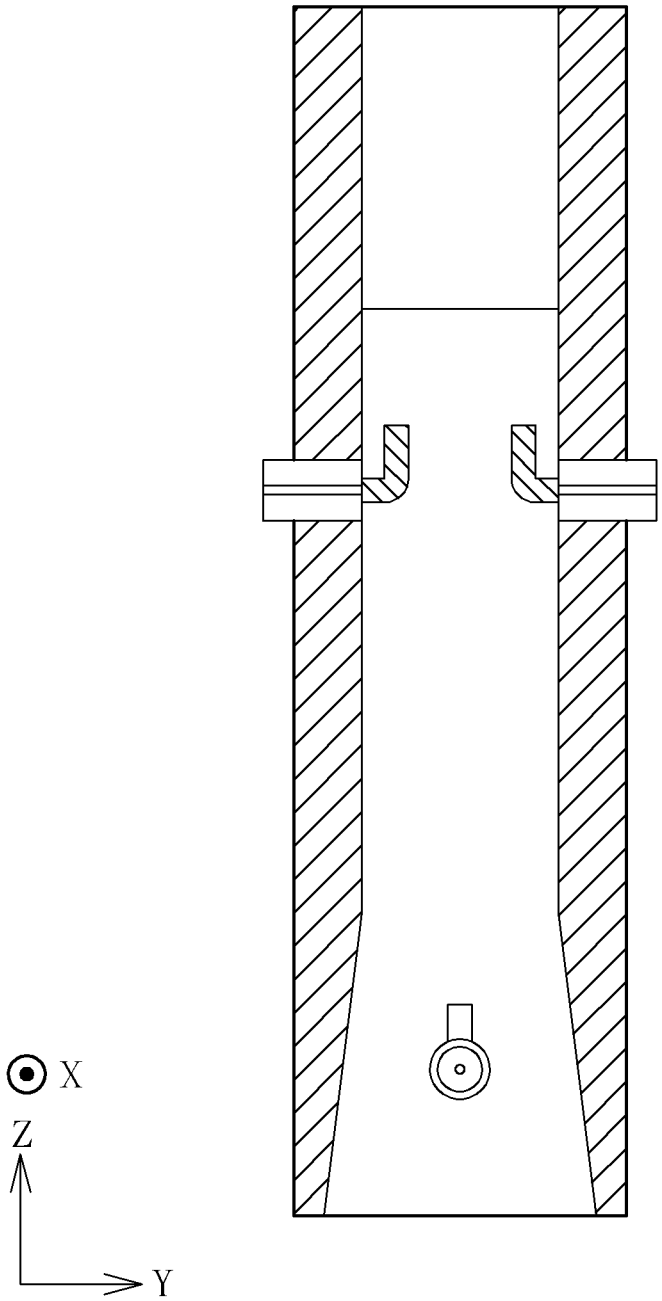
FIG. 8B and FIG. 8C are longitudinal sectional views of the orthomode transducer in FIG. 8A.
Figure 8C:
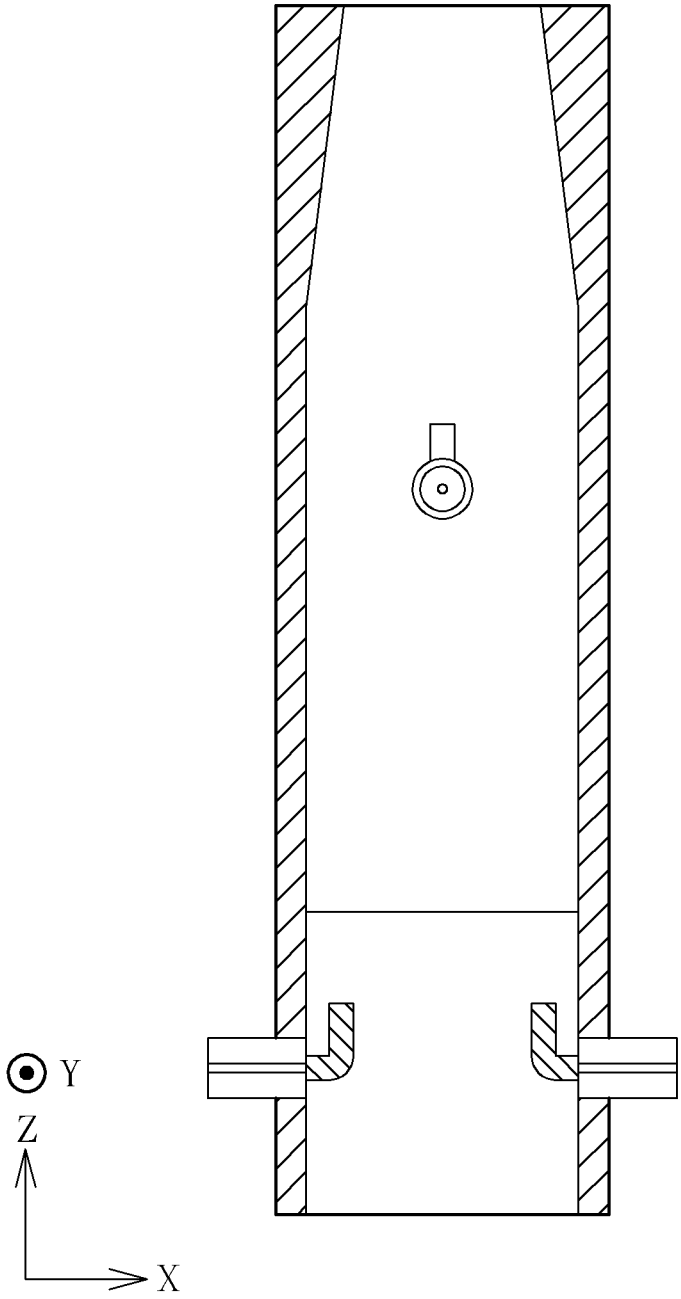
Figure 9A:
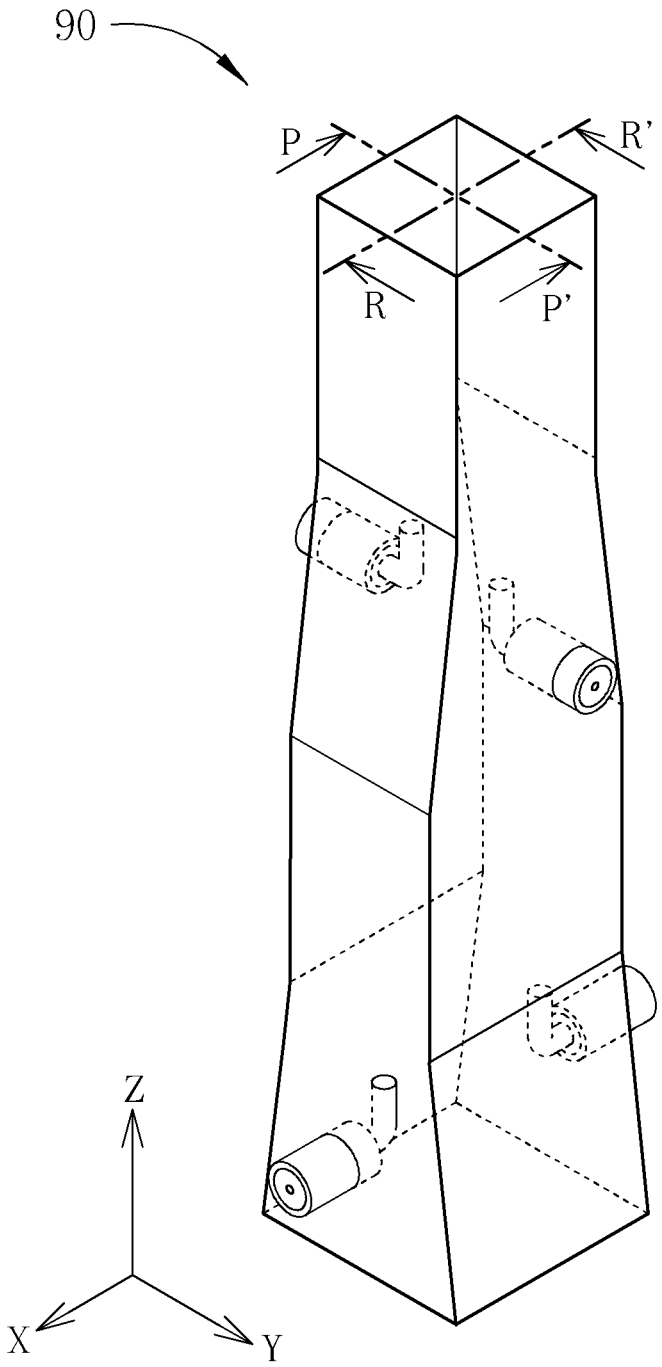
FIG. 9A is an isometric view of an orthomode transducer according to the present invention.
Figure 9B:
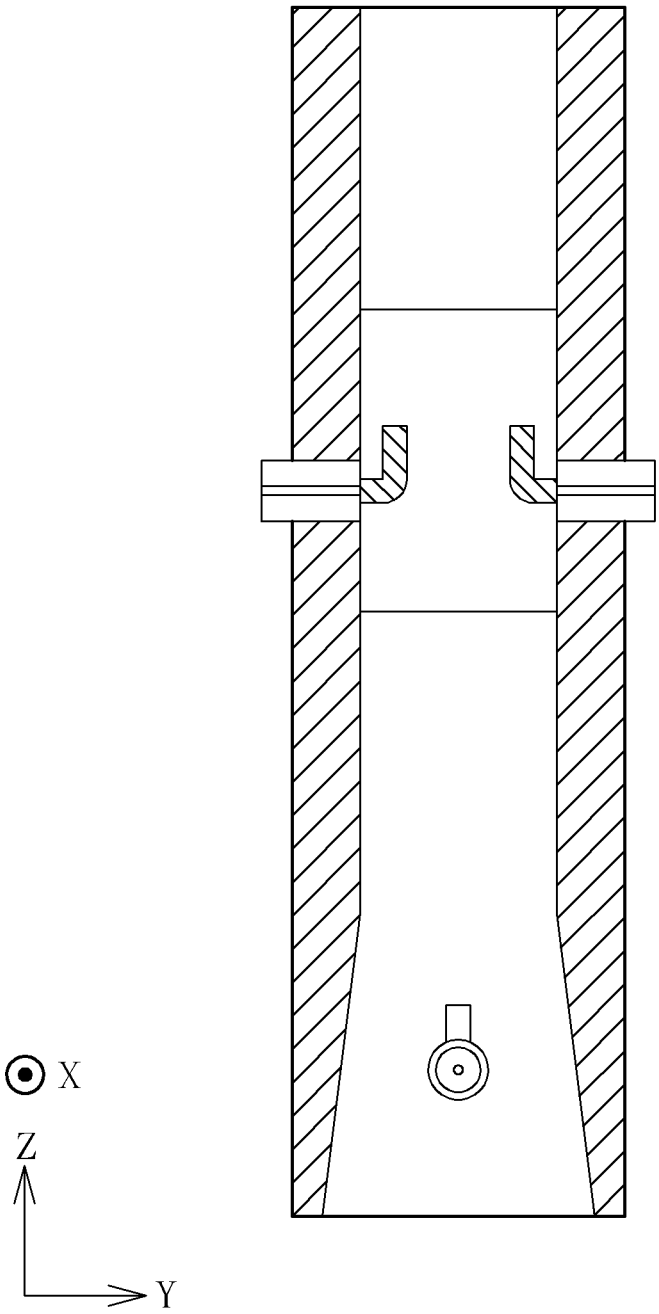
FIG. 9B and FIG. 9C are longitudinal sectional views of the orthomode transducer in FIG. 9A.
Figure 9C:
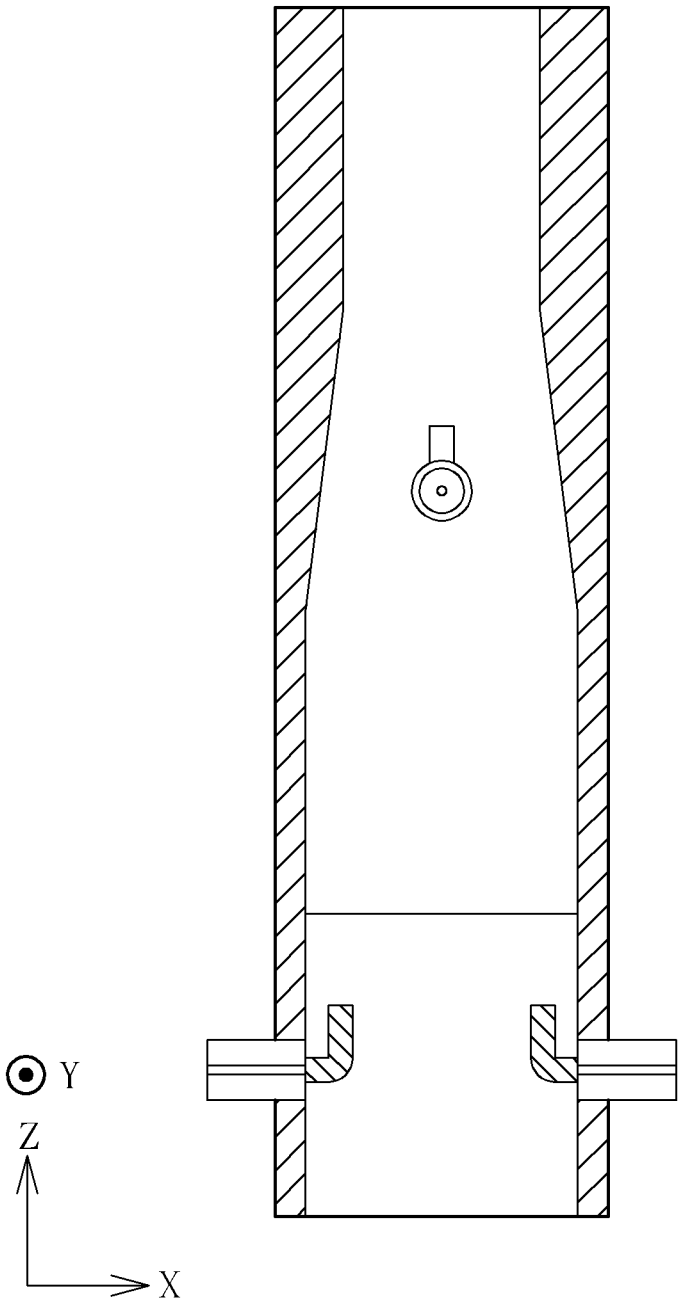

Under the condition of maintaining the taper of the size of the aperture of the waveguide of the orthomode transducer 30, where the taper starts in the waveguide portions can be adequately varied. Please refer to FIG. 8A, FIG. 8A is an isometric view of an orthomode transducer 80 according to the present invention, in which the orthomode transducer 80 is similar to the orthomode transducer 30, comprising a plurality of waveguide portions and probes. Please further refer to FIG. 8B and FIG. 8C, which are longitudinal sectional views of the orthomode transducer 80 along the P-P' section line and the R-R' section line respectively. It can be seen from FIG. 8A to FIG. 8C that the comparative positions of the tapered waveguide portions of the orthomode transducer 80 are different from the comparative positions of the tapered waveguide portions 312 and 320, but the number of the smoothly tapered waveguide portions is still two. The probes are disposed in the smoothly tapered waveguide portions, therefore, when the low frequency polarized signals are transmitting in the orthomode transducer 80, they are able to enter the cut-off status gradually, be reflected and outputted from each probes, and making the high frequency polarized signals pass through successfully. Please refer to FIG. 9A to FIG. 9C. FIG. 9A is an isometric view of an orthomode transducer 90 according to the present invention, and FIG. 9B and FIG. 9C are longitudinal sectional views of the orthomode transducer 90 along the P-P' section line and the R-R' section line respectively. The comparative positions of the tapered waveguide portions of the orthomode transducer 90 are different from the comparative positions in the orthomode transducer 30 and the orthomode transducer 80.

Figure 10A:
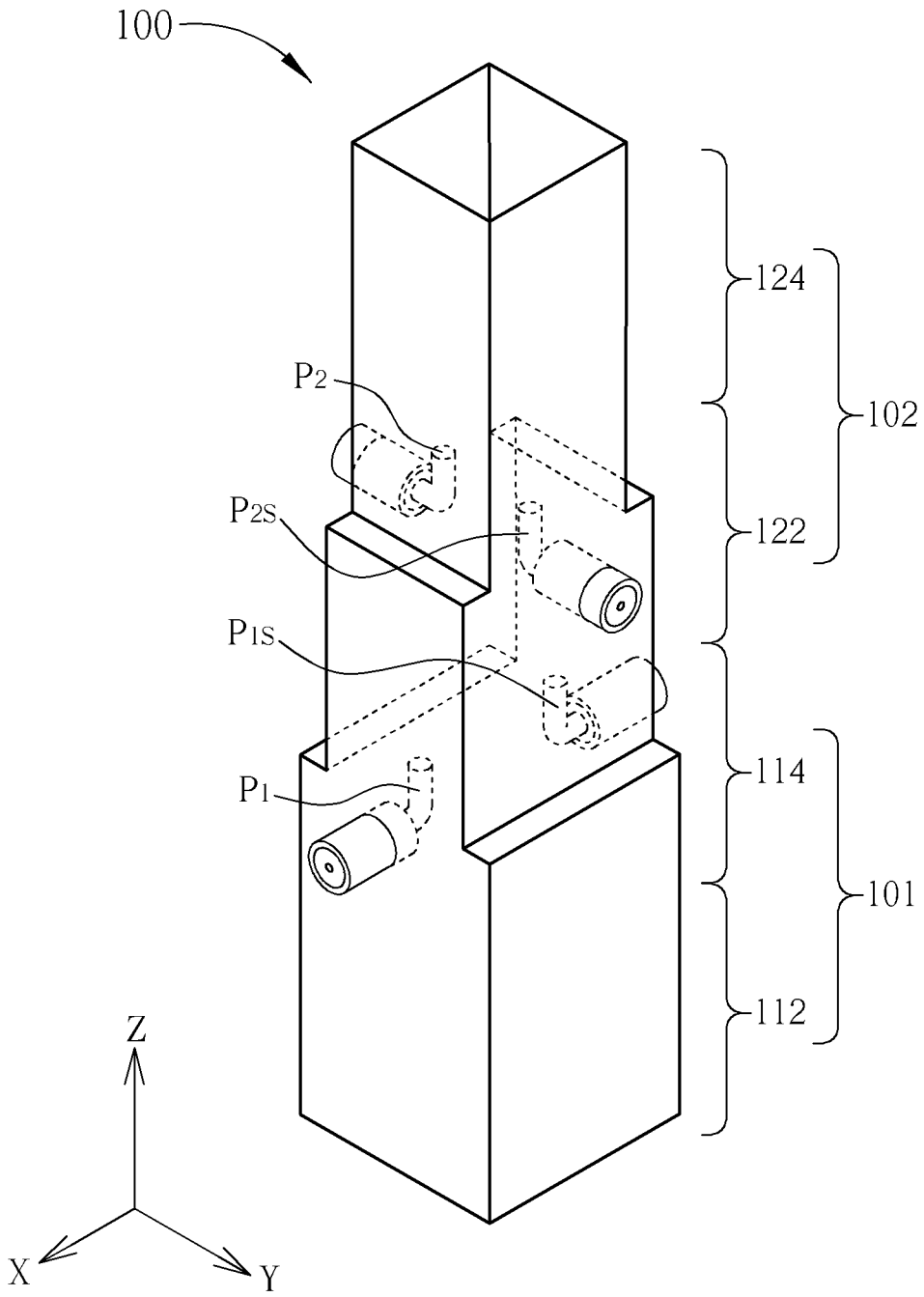
FIG. 10A is an isometric view of an orthomode transducer according to the present invention.
Figure 10B:
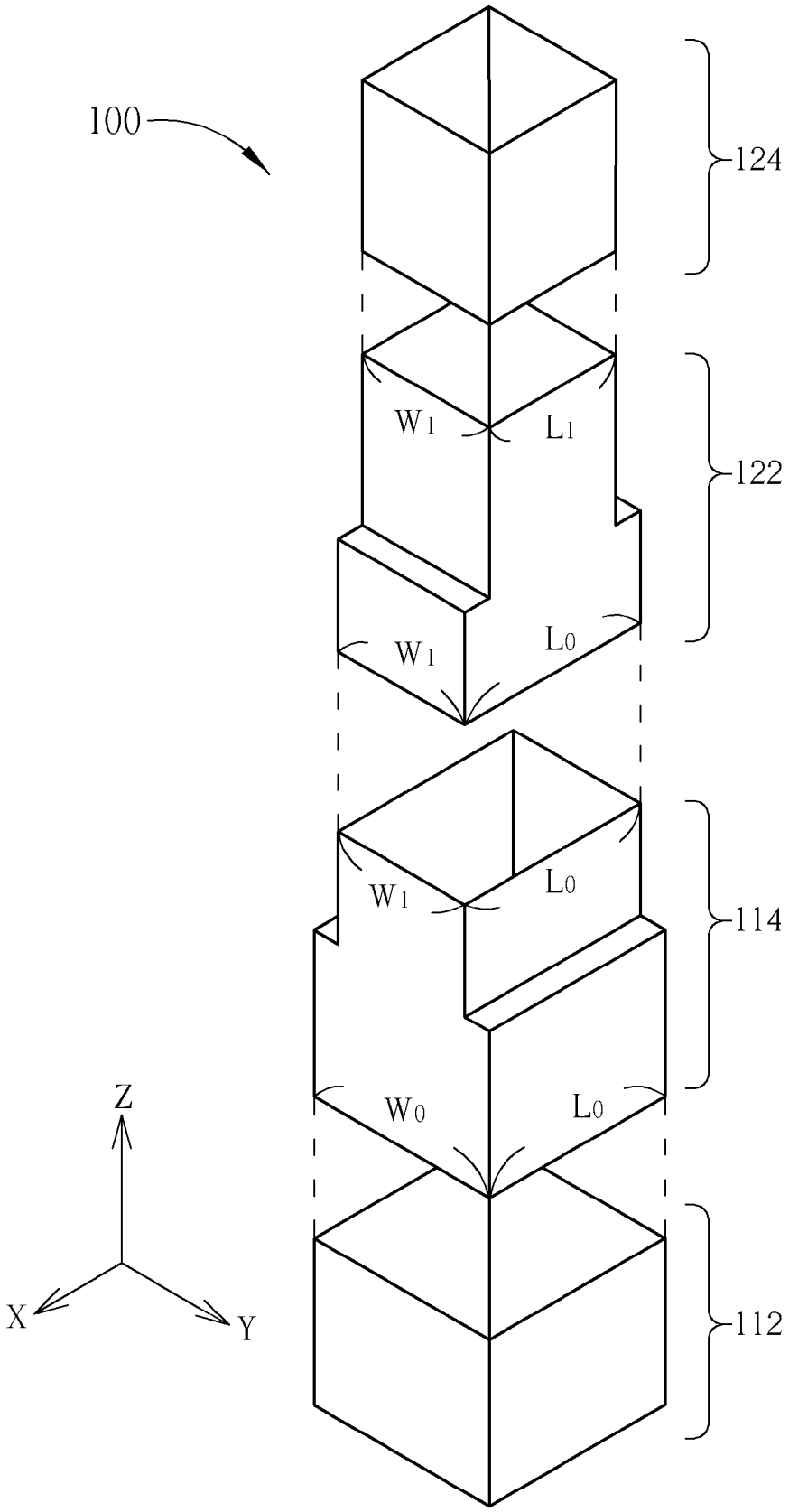
FIG. 10B is an exploded view of the waveguide portions of the orthomode transducer in FIG. 10A.

Please refer to FIG. 10A. FIG. 10A is an isometric view of an orthomode transducer 100 according to an embodiment of the present invention. The orthomode transducer 100 is similar to the orthomode transducer 30, comprising waveguide portions 101 and 102, and probes $P_1$, $P_{1S}$, $P_2$, and $P_{2S}$. The waveguide portion 101 is formed by a waveguide portion 112 and a waveguide portion 114, and the waveguide portion 102 is formed by a waveguide portion 122 and a waveguide portion 124, wherein the waveguide portion 114 and waveguide portion 122 taper. The exploded view of the orthomode transducer 100 is illustrated in FIG. 10B, and it can be shown that the size of the aperture of the waveguide portion 114 in Y direction does not smoothly taper from $W_0$ to $W_1$ as the waveguide portion 312, but shrinks directly from $W_0$ to $W_1$, making the conducting walls parallel to the YZ plane step-shaped rather than trapezoid. The probes $P_1$ and $P_{1S}$ tunnel a part of the waveguide portion 114 which has the larger size of the aperture in Y direction. Therefore, when low frequency X-polarized signals proceed to a part of the waveguide portion 114 which has the smaller size of the aperture in Y direction, the low frequency X-polarized signals gradually enter the cut-off status and are reflected to be outputted from the probe $P_1$ (or together with the probe $P_{1S}$, it depends on whether the probe $P_{1S}$ is short-circuited with the conducting walls or not.) Similarly, the size of the aperture of the waveguide portion 122 in X direction shrinks from $L_0$ to $L_1$, and the conducting walls parallel to the XZ plane are step-shaped. Similarly, the probes $P_2$ and $P_{2S}$ tunnel apart of the waveguide portion 122 which has the larger size of the aperture in X direction, therefore, when low frequency Y-polarized signals proceed to a part of the waveguide portion 122 which has the smaller size of the aperture in X direction, the low frequency Y-polarized signals gradually enter the cut-off status and are reflected to be outputted from the probe $P_2$ (or together with the probe $P_{2S}$).

As a whole, the size of the aperture of the waveguide of the orthomode transducer 100 is step-tapered, nevertheless, the orthomode transducer 100 can still provide the effect of the above orthomode transducer 30, making the transmission of the low frequency X-polarized signals and Y-polarized signals enter the cut-off status sequentially, and hence be reflected to be outputted from the corresponding output ports, while the high frequency polarized signals passing through successfully. Those skilled in the art can make alterations and variations to the orthomode transducer 100 according to the above variation embodiments of the orthomode transducer 30, and are not narrated herein.

Figure 11:
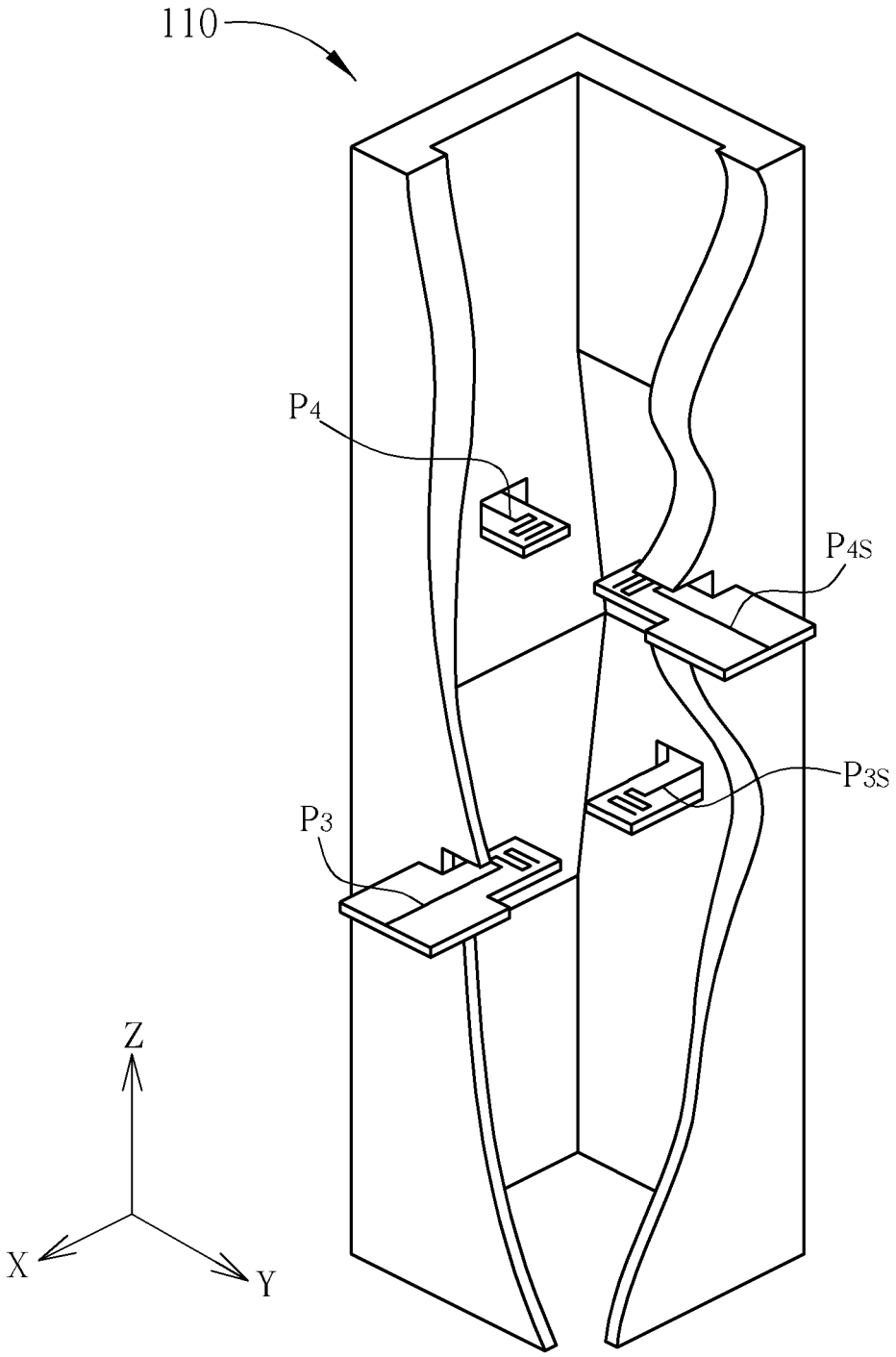
FIG. 11 is a half longitudinal sectional view of an orthomode transducer according to an embodiment of the present invention.
Figure 12:
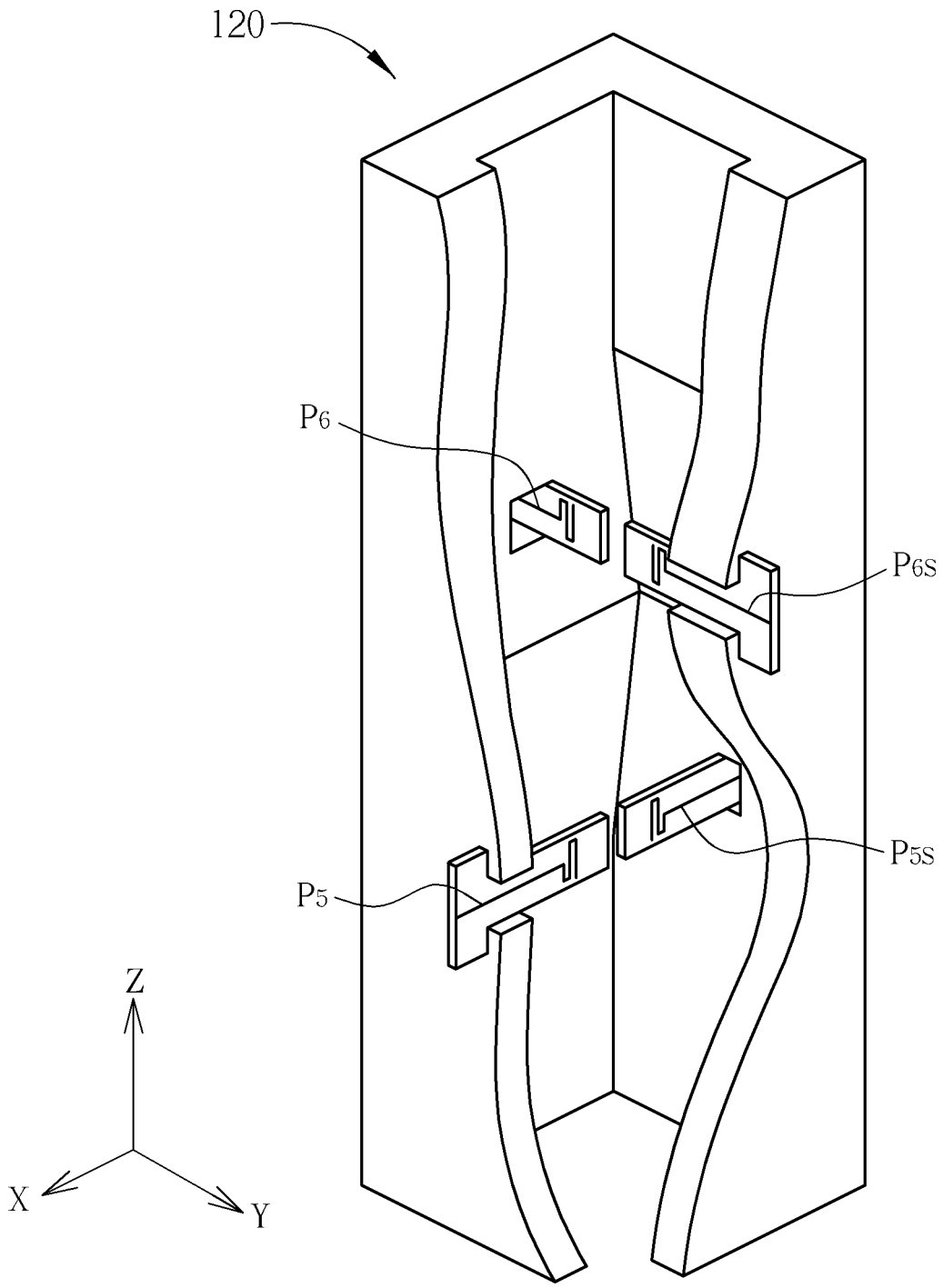
FIG. 12 is a half longitudinal sectional view of an orthomode transducer according to an embodiment of the present invention.

Besides inner conductors of coaxial cables, probes in orthomode transducer can also be realized in other format, such as microstrips disposed upon substrates of printed circuit boards. Please refer to FIG. 11. FIG. 11 is a half longitudinal sectional view of an orthomode transducer 110 according to an embodiment of the present invention. The formats of a plurality of waveguide portions of the orthomode transducer 110 are identical to that of the orthomode transducer 30 in FIG. 3, and are not narrated herein. The difference is that probes $P_3$, $P_{3S}$, $P_4$, and $P_{4S}$ comprised in the orthomode transducer 110 are meander microstrips disposed on substrates of the printed circuit boards, while each substrate where the probes disposed is parallel to the XY plane. The probes in FIG. 11 are disposed at planes facing the +Z direction, which can be altered to planes facing the −Z direction without influencing the output of the polarized signals. The conducting wall of the waveguide has a clearance upon each of the probes $P_3$, $P_{3S}$, $P_4$, and $P_{4S}$ for avoiding the contact of the probes with the conducting wall of the waveguide resulting in short-circuit. The objective of utilizing meander microstrips as probes is identical to the objective of forming a bend with the inner conductors of the coaxial cables in the orthomode transducer 30, which is to shorten the length that the probe stretch into the waveguide, to avoid the interference with the transmission of the high frequency signals in the waveguide, and further enhance the quality of the high frequency signals. In addition, please refer to FIG. 12. FIG. 12 is a half longitudinal sectional view of an orthomode transducer 120 according to an embodiment of the present invention. Probes $P_5$, $P_{5S}$, $P_6$, and $P_{6S}$ comprised in the orthomode transducer 120 are also meander microstrips. The substrates of the printed circuit boards where the probes $P_5$ and $P_{5S}$ disposed are parallel to the XZ plane, while substrates of the printed circuit boards where the probes $P_6$ and $P_{6S}$ disposed are parallel to the YZ plane. The conducting wall of the waveguide has a clearance by the side of each of the probes $P_5$, $P_{5S}$, $P_6$, and $P_{6S}$ for avoiding the contact of the probes with the conducting wall of the waveguide resulting in short-circuit. The applications of probes are not limited to inner conductors of coaxial cables or microstrips, which can also be formed by bending metal slices. The total length of the conductor in the internal space of the waveguide of the above-mentioned bending conductor probe or the total length of the stripes in the internal space of the waveguide of the meander microstrip probe in an adaptive frequency band, is approximately one-eighth of the wavelength (the wavelength of an electromagnetic wave transmitting in a vacuum) to one-half of the wavelength.

Figure 13:
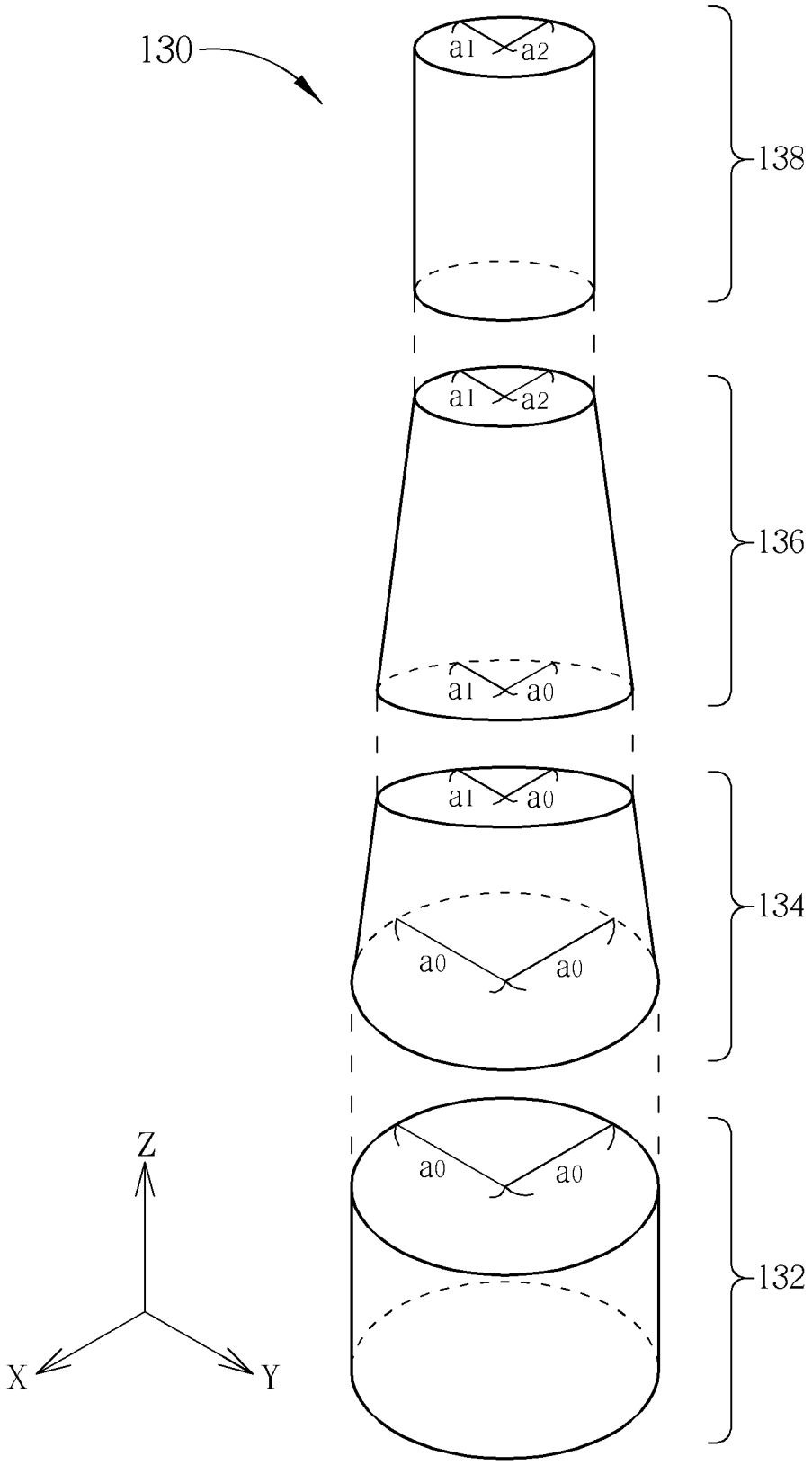
FIG. 13 is an exploded view of a waveguide of an orthomode transducer according to an embodiment of the present invention.

Please note herein, the above embodiments of orthomode transducers take rectangular waveguides as examples (considering the shape of the aperture of the waveguide), nevertheless, the present invention is not limited to the rectangular waveguides, and other shapes of two-staged tapered waveguide are also available, such as an ellipse waveguide. Please refer to FIG. 13. FIG. 13 is an exploded view of a waveguide of an orthomode transducer 130 according to an embodiment of the present invention. The orthomode transducer 130 comprises waveguide portions 132, 134, 136, and 138 and two pairs of probes located at the tapered waveguide portions 134 and 136. The probes in the orthomode transducer 130 are identical to the probes in the orthomode transducer 30, and the marks are abridged herein. The waveguide portion 132 is a circular waveguide with a radius of $a_0$. The waveguide portion 134 comprises one end having a circular aperture with a radius of $a_0$, connected to the waveguide portion 132 and the other end having an elliptical aperture with a major axis of $2a_0$ and a minor axis of $2a_1$; in other words, the size of the aperture of the waveguide portion 134 in Y direction tapers from $2a_0$ to $2a_1$. The waveguide portion 136 comprises one end connected to the waveguide portion 134 and the other end having an elliptical aperture with an axis of $2a_1$ and the other axis of $2a_2$; in other words, the size of the aperture of the waveguide portion 136 in Y direction maintains $2a_1$, while the size of the aperture in X direction tapers from $2a_0$ to $2a_2$. The waveguide portion 138 is a circular waveguide with a radius of $a_2$. Hence, the two-staged tapered waveguide of the orthomode transducer 130 are capable of forcing the low frequency polarized signals enter the cut-off status respectively while transmitting in the waveguide portions, and be reflected to the corresponding output ports; in the meanwhile, if the size of each tapered waveguide portions has been designed, the high frequency polarized signals would pass through successfully.

Figure 14A:
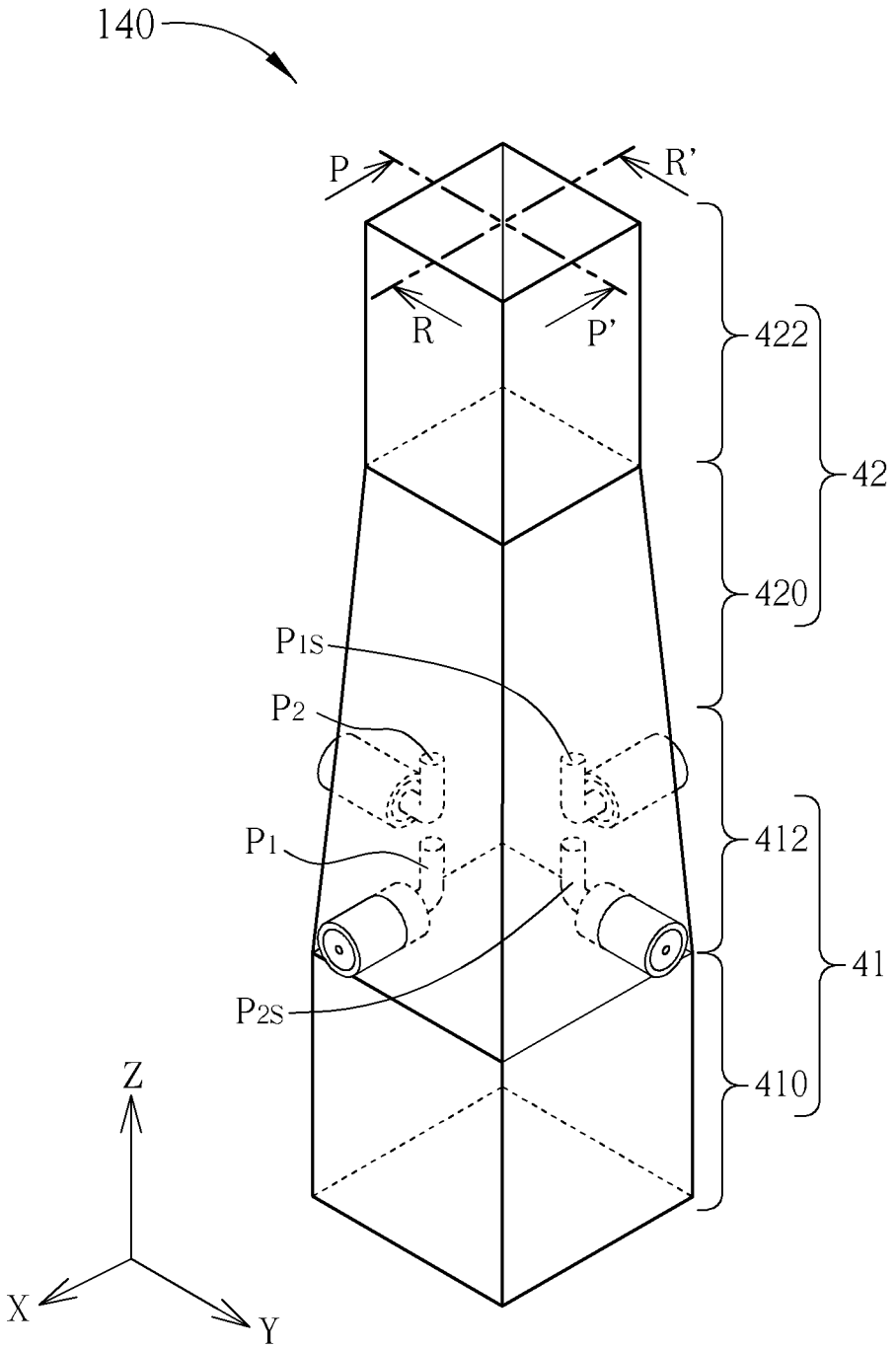
FIG. 14A is an isometric view of an orthomode transducer according to an embodiment of the present invention.
Figure 14B:
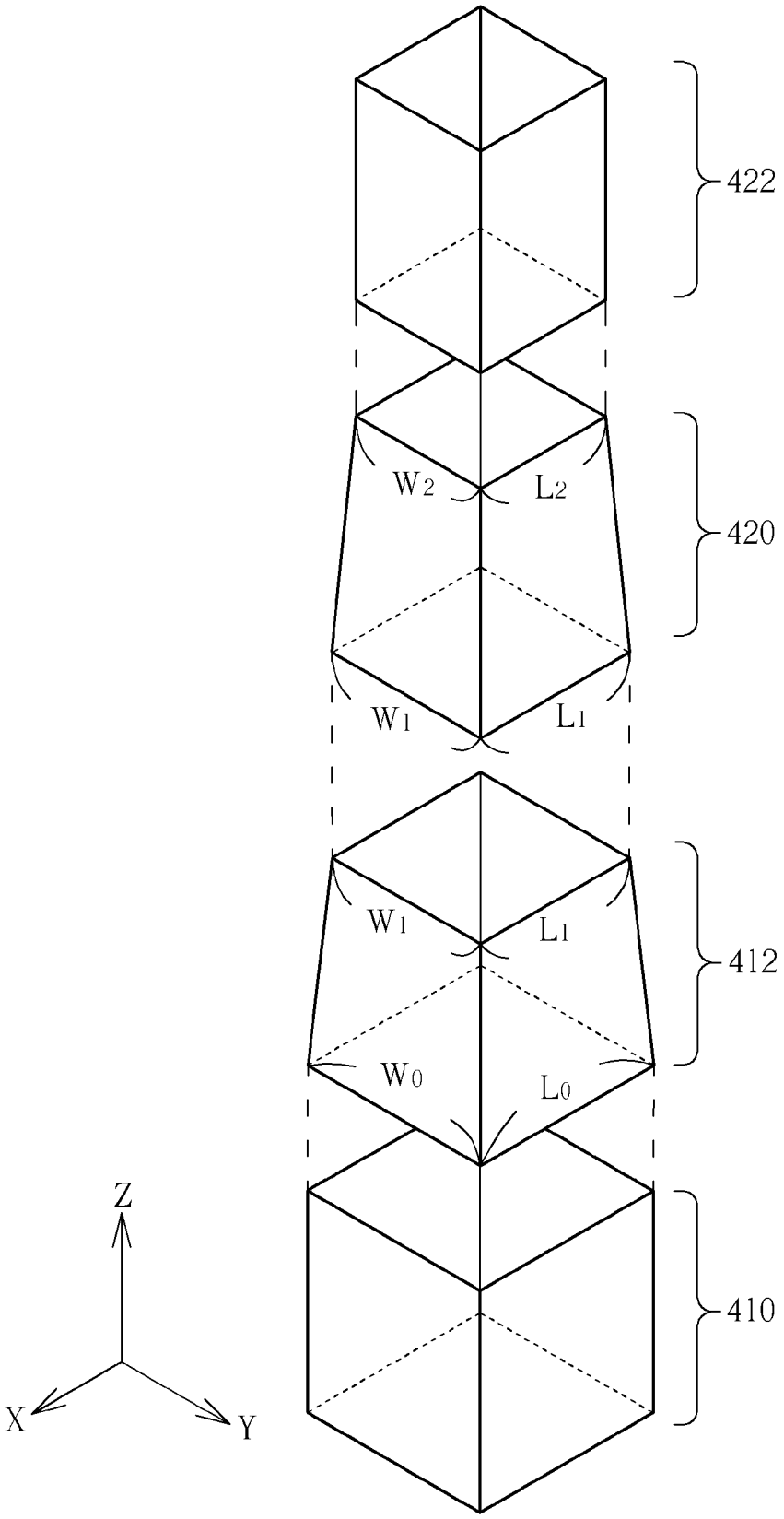
FIG. 14B is an exploded view of the waveguide portions of the orthomode transducer in FIG. 14A.

Please refer to FIG. 14A and FIG. 14B. FIG. 14A is an isometric view of an orthomode transducer 140 according to an embodiment of the present invention, and FIG. 14B is an exploded view of waveguide portions of the orthomode transducer 140, similar to FIG. 4A and FIG. 4B. The orthomode transducer 140 is a complete waveguide orthomode transducer and comprises waveguide portions 41 and 42, and probes $P_1$, $P_{1S}$, $P_2$, and $P_{2S}$. The waveguide portion 41 is formed by a waveguide portion 410 and a waveguide portion 412; the waveguide portion 42 is formed by a waveguide portion 420 and a waveguide portion 422. A significant difference between the orthomode transducer 30 of FIG. 4A and the orthomode transducer 140 of FIG. 14 A is that the probes $P_1$, $P_{1S}$, $P_2$, and $P_{2S}$ of the orthomode transducer 140 are coplanar, disposed at the same waveguide portion 412 instead of being disposed at different waveguide portions as in the orthomode transducer 30. Positions of the $P_1$, $P_{1S}$, $P_2$, and $P_{2S}$ of the orthomode transducer 140 form a plane perpendicular to the +Z direction.

Another difference between the orthomode transducer 30 and the orthomode transducer 140 is that the size of the aperture of the waveguide portions 412 and 420 are smoothly taper in both of X and Y directions; that is, the size of the aperture of the waveguide portion 412 tapers from $W_0 \times L_0$ to $W_1 \times L_1$ and the size of the aperture of the waveguide portions 420 tapers from $W_1 \times L_1$ to $W_2 \times L_2$. Therefore, the low frequency X-polarized and Y-polarized signals can also enter a cut-off status when proceeding in the waveguide portions 412 and 420 and can be reflected into corresponding low frequency signal output ports as the probes $P_1$, $P_{1S}$, $P_2$, and $P_{2S}$.

In a special case that the waveguide portion 412 and the waveguide portion 420 taper in the same proportion, the combination of the waveguide portions 412 and 420 is taken as a whole waveguide portion that continuously tapers from $W_0 \times L_0$ to $W_2 \times L_2$. In other words, the orthomode transducer 140 is regarded as being single-stage taper instead of two-stage taper as the orthomode transducer 30.

Note that, under the requirement that the probes $P_1$, $P_{1S}$, $P_2$, and $P_{2S}$ are coplanar on a plane perpendicular to the +Z direction, these four probes can be disposed at any position along +Z direction on the taper waveguide portion 412 or 420 other than the positions shown in FIG. 14A. The probes $P_1$, $P_{1S}$, $P_2$, and $P_{2S}$ are bending probes formed by inner conductors of coaxial cables, and can also be made of meander microstrips instead. The orthomode transducer 140 is merely an embodiment of the present invention, and those skilled in the art can make alterations and modifications accordingly.

To sum up, in the single-stage or two-stage tapered waveguide orthomode transducer of the present invention, the low frequency X-polarized and Y-polarized signals enter the cut-off status while transmitting in the waveguide portions owing to the taper waveguide portions, and thereby are reflected to the corresponding output ports; in the meanwhile, the high frequency polarized signals pass through the waveguide orthomode transducer successfully. The symmetrically disposed probes can preferably suppress the higher-order mode excitation and decrease the distortion of the radiation patterns of the antenna. In addition, the bending probes shorten the length that the probe stretch into the waveguide, avoiding the interference with the transmission of the high frequency signals. Therefore, the waveguide orthomode transducer of the present invention is more feasible to dual-band satellite communication receivers.

Those skilled in the art will readily observe that numerous modifications and alterations of the device and method may be made while retaining the teachings of the invention.

What is claimed is:

1. A waveguide orthomode transducer comprises:

a waveguide comprising a first waveguide portion and a second waveguide portion placed along a transmission direction of radio signals, the size of an aperture of the second waveguide portion smaller than the size of an aperture of the first waveguide portion;

a first probe disposed at a first position;

a second probe disposed at a second position;

a third probe disposed at a third position; and a fourth probe disposed at a fourth position, wherein at least two of the first position, the second position, the third position, and the fourth position are located in the same plane perpendicular to the transmission direction of the radio signals;

wherein the first probe is utilized for transmitting a first polarized signal and the third probe is utilized for transmitting a second polarized signal, the polarization of the second polarized signal being orthogonal to the polarization of the first polarized signal.

2. The waveguide orthomode transducer of claim 1, wherein the first waveguide portion comprises at least a first sub-portion, and the size of an aperture of the first sub-portion tapers toward transmission direction of radio signals.

3. The waveguide orthomode transducer of claim 2, wherein the second waveguide portion comprises at least a second sub-portion, and the size of an aperture of the second sub-portion tapers toward transmission direction of radio signals.

4. The waveguide orthomode transducer of claim 3, wherein the size of the aperture of the first sub-portion and the size of the aperture of the second sub-portion are step-tapered.

5. The waveguide orthomode transducer of claim 4, wherein the first position and the second position are located in a part of the first sub-portion whose aperture is larger than the aperture of another part of the first sub-portion, and the third position and the fourth position are located in a part of the second sub-portion whose aperture is larger than of the aperture of another part of the second sub-portion.

6. The waveguide orthomode transducer of claim 3, wherein the size of the aperture of the first sub-portion and the size of the aperture of the second sub-portion are smoothly tapered.

7. The waveguide orthomode transducer of claim 6, wherein the first position and the second position are located in the first sub-portion, and the third position and the fourth position are located in the second sub-portion.

8. The waveguide orthomode transducer of claim 6, wherein the first position, the second position, the third position, and the fourth position are all located in the first sub-portion or all located in the second sub-portion.

9. The waveguide orthomode transducer of claim 1, wherein the aperture of the waveguide is quadrilateral.

10. The waveguide orthomode transducer of claim 9, wherein the first probe and the second probe are located on opposite inner surfaces of the waveguide.

11. The waveguide orthomode transducer of claim 9, wherein the first probe and the third probe are located on adjacent inner surfaces of the waveguide.

12. The waveguide orthomode transducer of claim 1, wherein a line passing through the first position and the second position is not parallel to a line passing through the third position and the fourth position.

13. The waveguide orthomode transducer of claim 1, wherein a projection of a line passing through the first position and the second position on a section of the waveguide is approximately perpendicular to a projection of a line passing through the third position and the fourth position on the section.

14. The waveguide orthomode transducer of claim 1, wherein a line passing through the first position and the second position is approximately perpendicular to a central axis of the waveguide.

15. The waveguide orthomode transducer of claim 14, wherein a line passing through the third position and the fourth position is approximately perpendicular to a central axis of the waveguide.

16. The waveguide orthomode transducer of claim 1, wherein the distance between the first position and the second position is larger than the distance between the third position and the fourth position.

17. The waveguide orthomode transducer of claim 1, wherein the waveguide is provided with tapered apertures.

18. The waveguide orthomode transducer of claim 1, wherein the second probe is utilized for transmitting the first polarized signal, and the fourth probe is utilized for transmitting the second polarized signal.

19. The waveguide orthomode transducer of claim 1, wherein the second probe and the fourth probe are short-circuited with an outer surface of the waveguide.

20. The waveguide orthomode transducer of claim 1, wherein each of the first and the second probes includes at least a bend that keeps a free end of a corresponding one of the first and the second probes away from the center of the waveguide.

21. The waveguide orthomode transducer of claim 20, wherein the bending directions of the first and the second probes are identical.

22. The waveguide orthomode transducer of claim 20, wherein the bending directions of the first and the second probes are different.

23. The waveguide orthomode transducer of claim 1, wherein the first probe is a conductor.

24. The waveguide orthomode transducer of claim 1, wherein the first probe comprises:

a first substrate; and a first microstrip disposed on the first substrate.

25. The waveguide orthomode transducer of claim 24, wherein the second probe comprises:

a second substrate; and a second microstrip disposed on the second substrate.

26. The waveguide orthomode transducer of claim 25, wherein the first substrate is parallel to the second substrate.

27. The waveguide orthomode transducer of claim 26, wherein a plane on which the first substrate is disposed is parallel to a section of the waveguide.

28. The waveguide orthomode transducer of claim 26, wherein a plane on which the first substrate is disposed is perpendicular to a section of the waveguide.

* * * * *